US009704389B2

(12) United States Patent
Hirabayashi

(10) Patent No.: US 9,704,389 B2
(45) Date of Patent: Jul. 11, 2017

(54) TERMINAL DEVICE AND REMOTE CONTROL METHOD

(71) Applicant: Hitachi Maxell, Ltd., Osaka (JP)

(72) Inventor: Masayuki Hirabayashi, Osaka (JP)

(73) Assignee: HITACHI MAXELL, LTD., Osaka (JP)

( * ) Notice: Subject to any disclaimer, the term of this patent is extended or adjusted under 35 U.S.C. 154(b) by 0 days.

(21) Appl. No.: 14/895,474

(22) PCT Filed: Jun. 7, 2013

(86) PCT No.: PCT/JP2013/065772
§ 371 (c)(1),
(2) Date: Dec. 2, 2015

(87) PCT Pub. No.: WO2014/196072
PCT Pub. Date: Dec. 11, 2014

(65) Prior Publication Data

US 2016/0117919 A1 Apr. 28, 2016

(51) Int. Cl.
*G08C 17/02* (2006.01)

(52) U.S. Cl.
CPC ..... *G08C 17/02* (2013.01); *G08C 2201/91* (2013.01)

(58) Field of Classification Search
CPC ..... G08C 17/02; G08C 2201/91
See application file for complete search history.

(56) References Cited

U.S. PATENT DOCUMENTS 6,297,746 B1 * 10/2001 Nakazawa ..... G08C 17/02 340/12.5
2004/0121725 A1 6/2004 Matsui
(Continued)

FOREIGN PATENT DOCUMENTS

JP H09-307968 A 11/1997
JP 2003-309884 A 10/2003
(Continued)

OTHER PUBLICATIONS

International Search Report dated Jul. 16, 2013, received in related International Application No. PCT/JP2013/065772, filed Jun. 7, 2013 (translation is provided).

*Primary Examiner* — Leon Flores
(74) *Attorney, Agent, or Firm* — McDermott Will & Emery LLP

(57) ABSTRACT

An objective of the present invention is to provide an easy to use terminal device and remote control method. Provided is a terminal device having electric equipment remote control function, comprising a location information detection means for acquiring the present location of the terminal device, a near field communication means, and an information storage means. Upon acquiring identification information of electric equipment by the near field communication means, the location information is detected by the location information detection means, linked with the identification information of the electric equipment, and stored in the storage means. To carry out the remote control of the electric equipment, the location information is detected by the location information detection means, the distance between the location information and the location information stored in the storage means is computed, and the control is switched according to the distance.

6 Claims, 26 Drawing Sheets

(56) References Cited

U.S. PATENT DOCUMENTS

| | | | | |
|---|---|---|---|---|
| 2009/0055524 | A1* | 2/2009 | Tokunaga ..... | G06Q 10/02<br>709/224 |
| 2014/0009268 | A1 | 1/2014 | Oshima et al. | |

FOREIGN PATENT DOCUMENTS

| | | | |
|---|---|---|---|
| JP | 2004-166193 | A | 6/2004 |
| JP | 2004-320209 | A | 11/2004 |
| JP | 2008-306667 | A | 12/2008 |
| JP | 2009-303014 | A | 12/2009 |
| WO | 2012/070251 | A1 | 5/2012 |

* cited by examiner

TERMINAL DEVICE AND REMOTE CONTROL METHOD

CROSS-REFERENCE

This application is the U.S. National Phase under 35 U.S.C. §371 of International Application No. PCT/JP2013/065772, filed Jun. 7, 2013, to which the entire contents are hereby incorporated by reference.

TECHNICAL FIELD

The present invention relates to a terminal device and a remote control method.

BACKGROUND ART

Japanese Patent Application Publication No. 2008-306667 (Patent Literature 1) is the background art of the present technical field. This publication discloses the following problem. "There is provided an information communication terminal which functions as a remote controller of other equipment in an available range."

A solution to this problem is disclosed as follows. "When TVs 3A and 3B as operation target devices are registered, a cellular phone 1 stores information regarding equipment and also information related to positions P1 and P2 at the time of registration operation. The cellular phone 1 acquires the present location at a predetermined timing. When the present location shifts from the position P1 registered in relation to the TV 3 to an area B in a predetermined range, it displays an icon (equipment C) for activating an application for a remote control mode of the TV 3."

CITATION LIST

Patent Literature

Patent Literature 1: Japanese Patent Application Publication No. 2008-306667

SUMMARY OF INVENTION

Technical Problem

The above-described Patent Literature 1 discloses the following effect. "According to the present invention, the information communication terminal can be controlled to function as a remote controller for a target device in an operation available range, with a simple configuration without requiring a complicated operation or transmission/reception of a large amount of information."

However, there is a problem. If the operation available range is made narrow, nearby equipment can easily be selected, while distant equipment cannot easily be selected. If the operation available range is made wide, distant equipment can easily be selected, while nearby equipment cannot easily be selected.

It is accordingly an object of the present invention to provide an easy-to-use terminal device and a remote control method.

Solution to Problem

To solve the above problem, adopted is, for example, a configuration described in the scope of claims.

The present application includes a plurality of means for solving the above problem, and an example thereof is a terminal device having a remote control function for electric equipment. The terminal device may include a location information detection means for acquiring a present location of the terminal device, a storage means for storing location information of the electric equipment, a distance calculation means for calculating a distance between the terminal device and the electric equipment, from location information of the terminal device which is acquired by the location information detection means and the location information of the electric equipment which is stored in the storage means, and a switching means for performing switching in accordance with whether the electric equipment is a target device to be operated, based on the distance calculated by the distance calculation means.

Advantageous Effects of Invention

According to the present invention, the electric equipment can be controlled by an easy operation.

Any matters, configurations, and effects other than the above will be apparent from the descriptions of the following embodiments.

DESCRIPTION OF EMBODIMENTS

Embodiments will hereinafter be described using drawings.

First Embodiment

Figure 1:
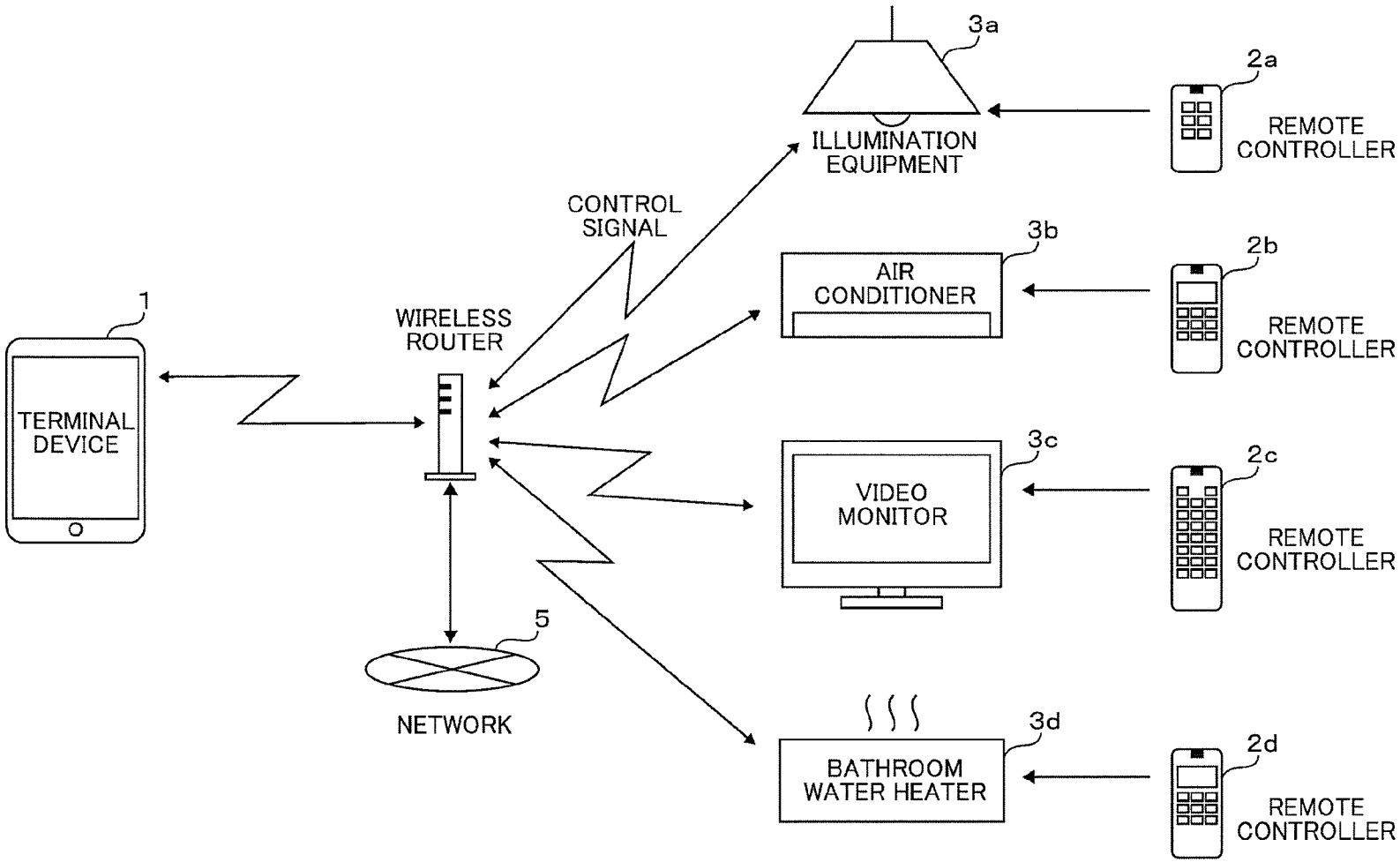
FIG. 1 is a diagram illustrating a configuration of a remote control system according to a first embodiment.

FIG. 1 is a diagram illustrating a configuration of a remote control system of a first embodiment of the present invention. The remote control system of this embodiment includes at least one terminal device and plural pieces of electric equipment.

A terminal device 1 has a wireless communication function to transmit/receive various information to/from an Internet network. Further, it has a function for performing remote control for electric equipment 3. A user can perform remote control for the electric equipment such as illumination equipment 3*a*, an air conditioner 3*b*, a video monitor 3*c*, and a bathroom water heater 3*d*, using the terminal device 1. The illumination equipment and the air conditioner are described as examples of the electric equipment to be remotely controlled. However, any other equipment that can utilize electricity for at least a part of controls are possible, and electric locks, gas appliances, such as gas heaters or gas ranges, and automobiles are also possible.

Remote controllers 2 are control devices dedicated respectively to the electric equipment, and can perform remote control for the corresponding electric equipment with infrared radiation. The remote controller 2*a* is dedicated to the illumination equipment 3*a*, the remote controller 2*b* is dedicated to the air conditioner 3*b*, the remote controller 2*c* is dedicated to the video monitor 3*c*, and the remote controller 2*d* is dedicated to the bathroom water heater 3*d*.

The illumination equipment 3*a* can be set to ON/OFF, or its brightness is set, by the terminal device 1 or remote controller 2*a*. The air conditioner 3*b* can be set to ON/OFF, a mode, or a temperature by the terminal device 1 or the remote controller 2*b*. The video monitor 3*c* can be set to ON/OFF, a channel, or a sound volume by the terminal device 1 or the remote controller 2*c*. The video monitor 3*c* can receive and display video contents, and receive, for example, a television signal wirelessly or by wire from a broadcast station, and display the video contents based on the television signal. It is also possible to display video contents, including Internet contents of a URL (Uniform Resource Locator) specified by a user, received from a network 5 through a wireless router 4. The bathroom water heater 3*d* can be set to a hot water supply mode or a temperature.

The wireless router 4 includes a wireless LAN (Local Area Network) function, such as Wi-Fi (Wireless Fidelity), and can be connected to the network 5 through a communication line. The terminal device 1 or the video monitor 3*c* is connected to the wireless router 4 to acquire video contents or various information from an Internet network, and can display it.

Figure 2:
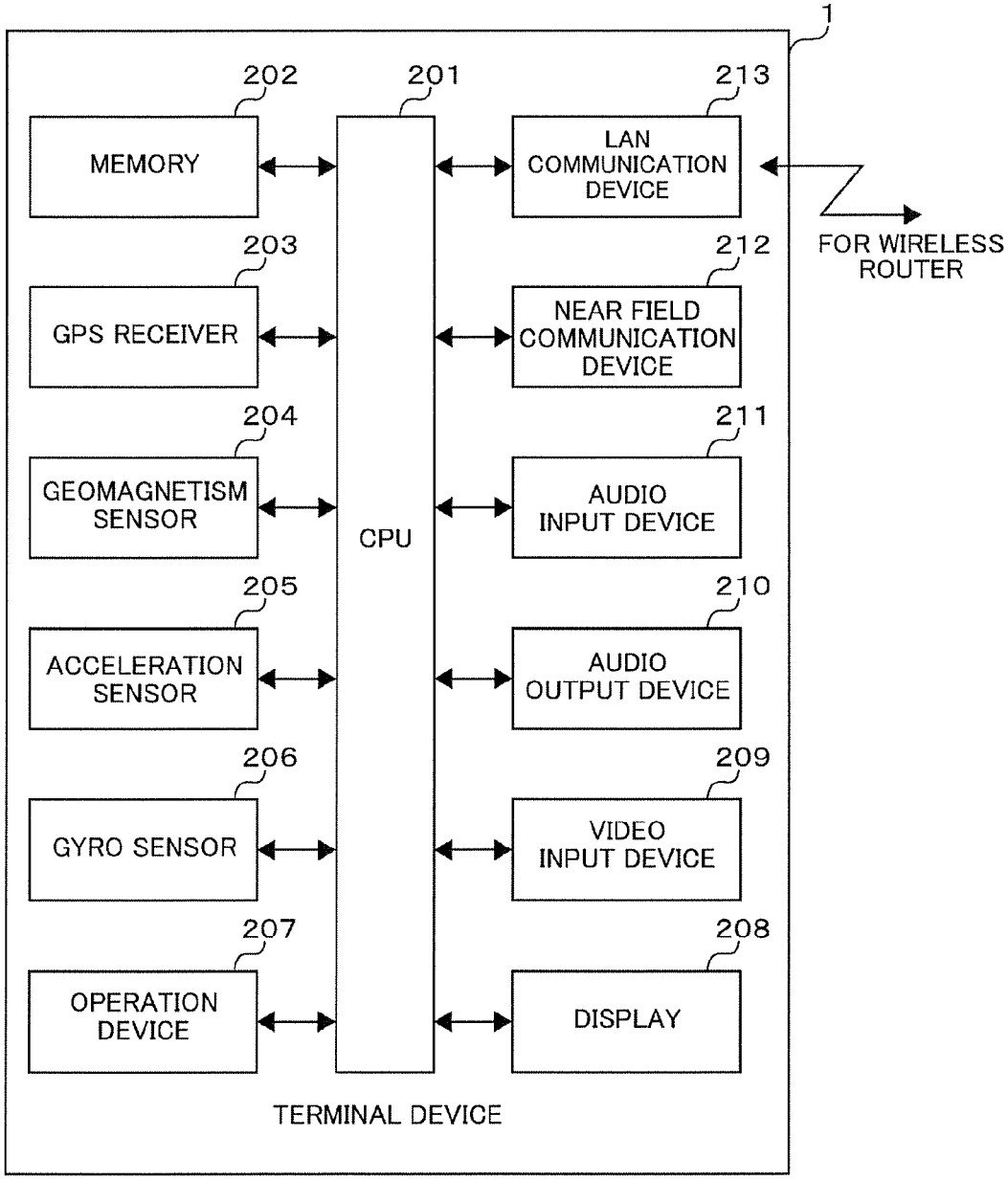
FIG. 2 is a hardware configuration diagram of a terminal device of the first embodiment.

FIG. 2 is a hardware configuration diagram of the terminal device 1 of FIG. 1.

The terminal device 1 may be a cellular phone or a tablet terminal, or may be PDA (Personal Digital Assistants) or a notebook PC (Personal Computer). The device may be a music player, a digital camera, a portable game player, or any other portable digital equipment, with a communication function.

Units of the terminal device 1 are controlled by a CPU (Central Processing Unit) 201. The CPU 201 may be an arbitrary control circuit, or may be a dedicated circuit, such as an ASIC (Appreciation Specific IC), and controls the terminal device 1 entirely in accordance with a predetermined program.

A memory 202 is configured with a ROM (Read Only Memory), a RAM (Random Access Memory), or a flash ROM, and stores a program for controlling the terminal device 1 and various setting values.

A GPS (Global Positioning System) receiver 203 includes an antenna, a decoding circuit, and the like, and is a reception device of a global positioning system which receives radio waves from a satellite to detect the location of the terminal device 1 on the earth.

It is possible to enhance the location accuracy by a DGPS (Differential GPS) receiving a correction signal of a GPS satellite from a base station and compensating the GPS information. It is possible to further enhance the location accuracy by a QZSS (Quasi-Zenith Satellite System) receiving a correction signal from a geosynchronous orbit satellite and complementing/reinforcing the GPS information. It is also possible to seamlessly perform indoor/outdoor positioning by an IMES (Indoor MEssaging system) receiving a signal having compatibility with the GPS satellite from an indoor GPS transmitter and acquiring location information.

A geomagnetism sensor 204, an acceleration sensor 205, and a gyro sensor 206 are a group of sensors for detecting the position or movement of a case of the terminal device 1. By this group of sensors, it is possible to detect the location, orientation, inclination, and movement of the terminal device 1. Any other sensor may further be included.

An operation device 207 is, for example, a touch pad, accepts a user operation, and transmits an instruction based on the operation to the CPU 201.

A display 208 is, for example, a liquid crystal panel, and displays various information. An integrated unit of a combination of a liquid crystal panel and a touch pad is generally called a touch panel, and this embodiment employs a usage example of a touch panel.

A video input device 209 is, for example, a camera, and converts light input from its lens into an electrical signal, thereby inputting image data of the surrounding or a target object.

An audio output device 210 is, for example, an amplifier and a speaker, and outputs various voices.

An audio input device 211 is, for example, a microphone, converts a user voice into voice data, and inputs it.

A near field communication device 212 performs near field wireless communication, for example, NFC (Near Field Communication), and can input/output various data.

A LAN communication device 213 can acquire various information from an Internet network through the wireless router 4, using, for example, Wi-Fi. Remote control of the electric equipment 3 can be performed by transmitting/receiving a control command or status, to/from the electric equipment 3 through the wireless router 4. The control command or status may be transmitted/received directly to/from the electric equipment 3 without through the wireless router 4, using, for example, Wi-Fi Direct, Bluetooth (registered trademark), or the like.

The near field communication device 212 and the LAN communication device 213 include an antenna, an encoding circuit, and a decoding circuit.

Figure 21:
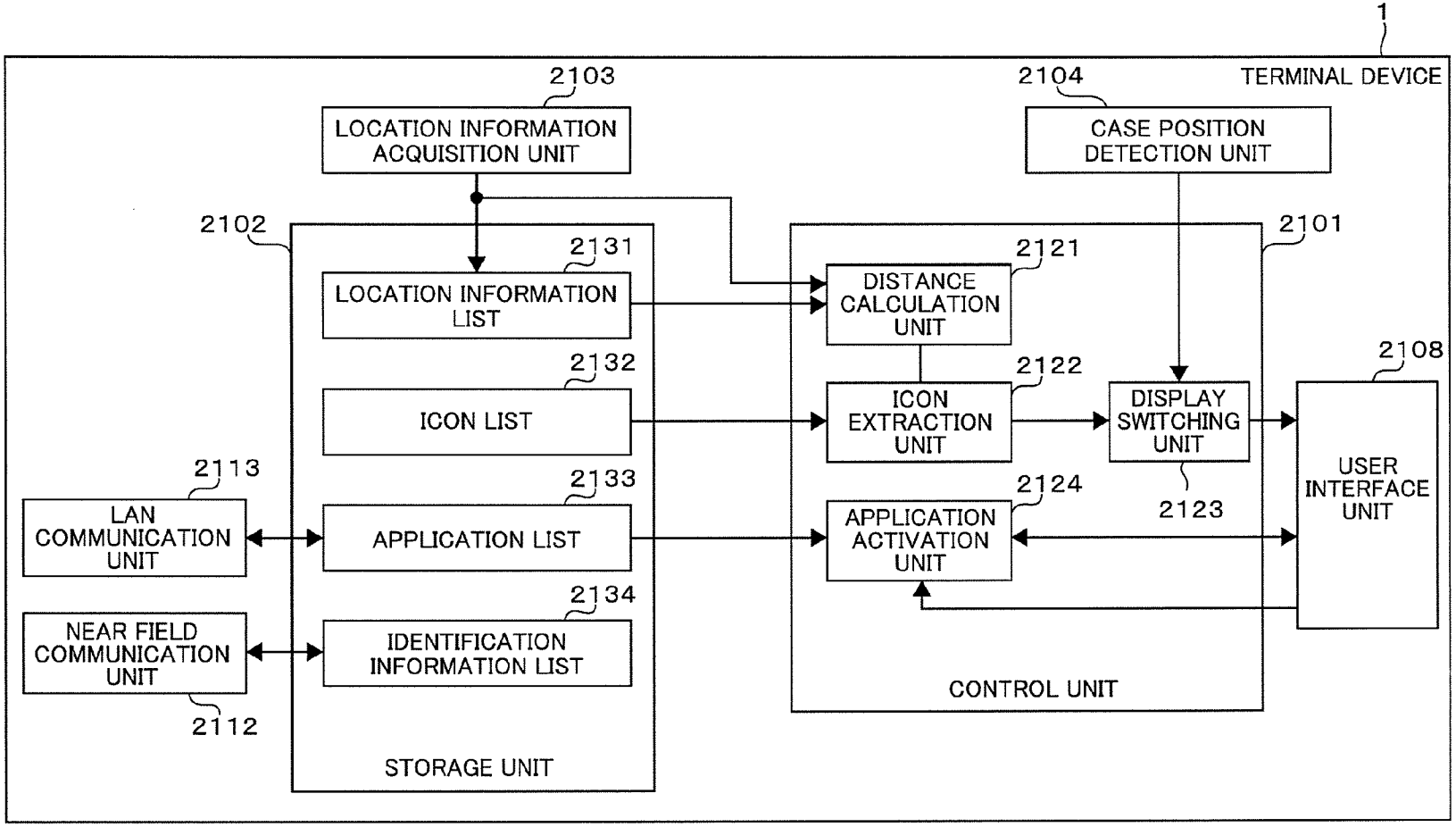
FIG. 21 is a functional block diagram of the terminal device of the first embodiment.

FIG. 21 is a functional block diagram of the terminal device 1 of FIG. 1. The function blocks of the terminal device 1 operate, for example, on the CPU 201 included in the terminal device 1 illustrated in FIG. 2.

A control unit 2101 includes a distance calculation unit 2121, an icon extraction unit 2122, a display switching unit 2123, and an application activation unit 2124, controls a storage unit 2102, a location information acquisition unit 2103, a case position detection unit 2104, a near field wireless communication unit 2112, and a LAN communication unit 2113, registers the electric equipment 3 before usage of the remote controller, selects the electric equipment 3 at the usage of the remote controller, and performs remote control, based on an instruction from a user interface unit 2108. The user interface unit 2108 is, for example, the operation device 207, the display 208, the video input device 209, the audio output device 210, the audio input device 211, or the like.

Before usage of the remote controller, the control unit 2101 acquires information necessary for remotely controlling the electric equipment 3, and registers it in the storage unit 2102. It acquires an identification signal, an icon, and a URL of a remote controller application of the electric equipment 3 through the near field wireless communication unit 2112, and stores them in an identification signal list 2134 and an icon list 2132 of the storage unit 2102. At the same time, the location information acquisition unit 2103 acquires location information of the electric equipment 3, and stores it in a location information list 2131 of the storage unit 2102. A remote controller application is acquired in accordance with the URL from the network 5 through the LAN communication unit 2113, and is stored in an application list 2133 of the storage unit 2102.

The remote controller application is application software for remotely controlling the electric equipment 3. Plural pieces of electric equipment 3 may be registered in the lists of the storage unit 2102. That is, location information, the icons, and remote controller applications are registered in relation to various identification information items.

At the usage of the remote controller, the control unit 2101 selects the electric equipment 3 to be remotely controlled, of the electric equipment registered in the storage unit 2102. The location information acquisition unit 2103 acquires the location information while the distance calculation unit 2121 calculates the distances to the plural pieces of electric equipment 3 in the location information list 2131. The icon extraction unit 2122 extracts icons of the electric equipment 3 in a preset predetermined distance A and icons of the electric equipment 3 in a preset predetermined distance B, from the icon list 2132, based on the distances. The case position detection unit 2104 detects a position (direction) of a case of the terminal device 1 while the display switching unit 2123 switches outputs to be displayed on the user interface unit 2108 based on the position (direction) of the case. For example, when the case is in a vertical attitude, the icons of the electric equipment 3 in the predetermined distance A are displayed. When the case is in a horizontal attitude, the icons of the electric equipment 3 in the predetermined distance B are displayed.

Of the icons displayed on the user interface unit 2108, the user selects an icon of desired electric equipment 3, and the application activation unit 2124 activates the remote controller application corresponding to this icon in the application list 2133.

Figure 3:
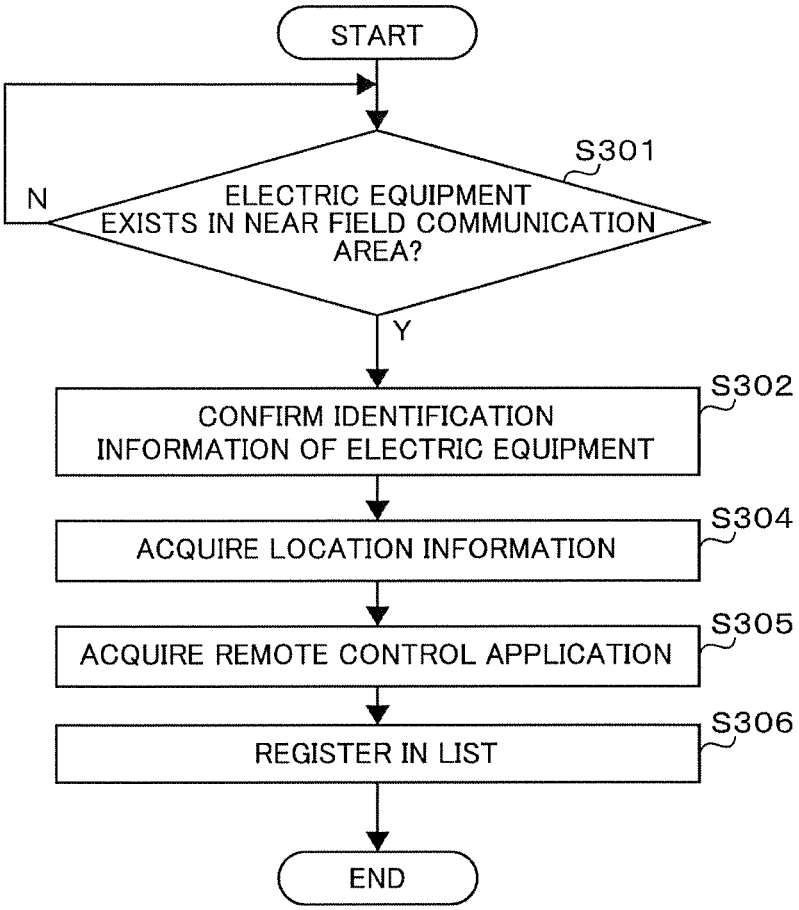
FIG. 3 is a flowchart for explaining a process for registering electric equipment of the first embodiment.

Accordingly, the user can remotely control the desired electric equipment 3. FIG. 3 is a flowchart illustrating a process for registering electric equipment 3 by the terminal device 1 of the first embodiment of the present invention. For remote control of the electric equipment 3, it is necessary to register this electric equipment 3. In the present invention, the application software for calling the remote controller application is called a launcher application in order to distinguish it from the remote controller application. In the present invention, the remote controller application is to be registered and called with using the launcher application. In Step S301, in the terminal device 1, the near field communication unit 2112 confirms whether the electric equipment 3 exists in a communication area of the near field wireless communication. When the electric equipment 3 exists in the communication area, the launcher application is activated, and the electric equipment is registered.

In Step S302, the identification information is confirmed.

In Step S304, the location information acquisition unit 2103 acquires the present location information. At present, the corresponding electric equipment 3 exists in the same location as that of the terminal device 1. Thus, the acquired location information is location information of the corresponding electric equipment 3.

In Step S305, the terminal device 1 acquires the remote controller application of the corresponding electric equipment 3. The remote controller application may be acquired from an Internet network in accordance with the URL specified by the electric equipment 3, or may be acquired directly from the electric equipment 3. Further, product information may be acquired from the Internet network or the corresponding electric equipment 3.

In Step S306, identification information of the electric equipment 3, the remote controller application, the location information, and the product information are registered in the lists, and the process is ended.

When the electric equipment 3 exists in the communication area of the near field wireless communication, the remote controller application can also be activated.

Figure 4:
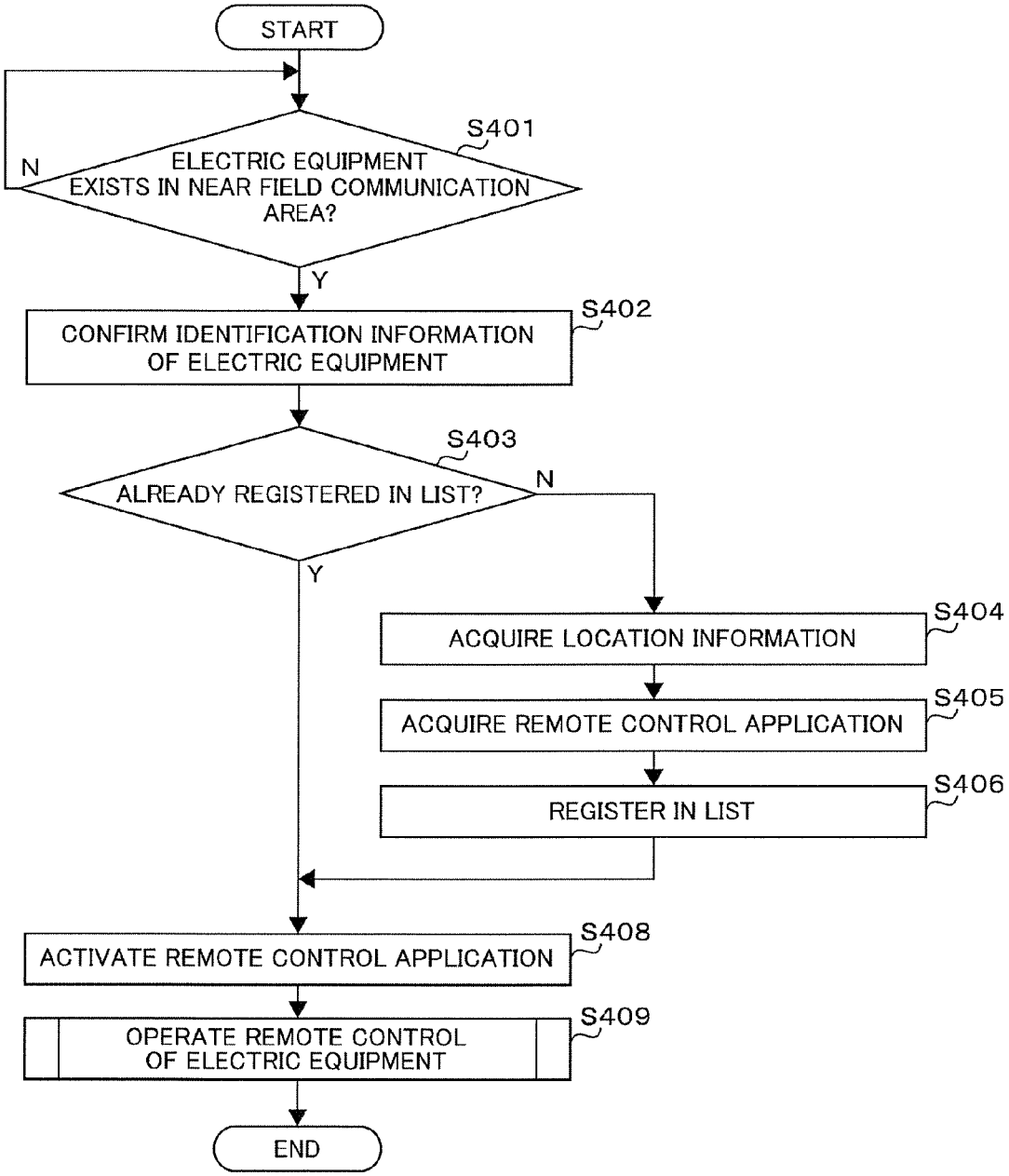
FIG. 4 is a flowchart for explaining a process for registering the electric equipment of the first embodiment.

FIG. 4 is a flowchart illustrating another example of a process for registering the electric equipment 3 by the terminal device 1 of the first embodiment of the present invention. In this process, a process for activating the remote controller application is added to the registration process of FIG. 3.

In Step S401 to Step S402, the same procedures as those of Step S301 to Step S302 are performed, and thus will not be described again.

In Step S403, the terminal device 1 confirms whether the electric equipment 3 has already been registered in the list stored in a memory 202. If the electric equipment 3 exists in the list, it has already been registered. If the electric equipment does not exist in the list, it has not been registered. When the electric equipment 3 has already been registered, the flow proceeds to Step S408. When it has not been registered, the flow proceeds to Step S404.

In Step S404 to S406, the same procedures as those of Step S304 to Step S306 are performed. The present location information and the remote controller application are acquired. The identification information of the electric equipment 3, the remote controller application, the location information, and the product information are registered in the lists.

The flow proceeds to Step S408, in which the terminal device 1 activates the remote controller application. In Step S409, the electric equipment 3 is remotely operated. Upon completion of the remote operation, the process is ended.

When the electric equipment 3 has already been registered in the list, confirmation is made as to whether the location information is the latest information. When the location shifts, the location information may be registered again.

Figure 5:
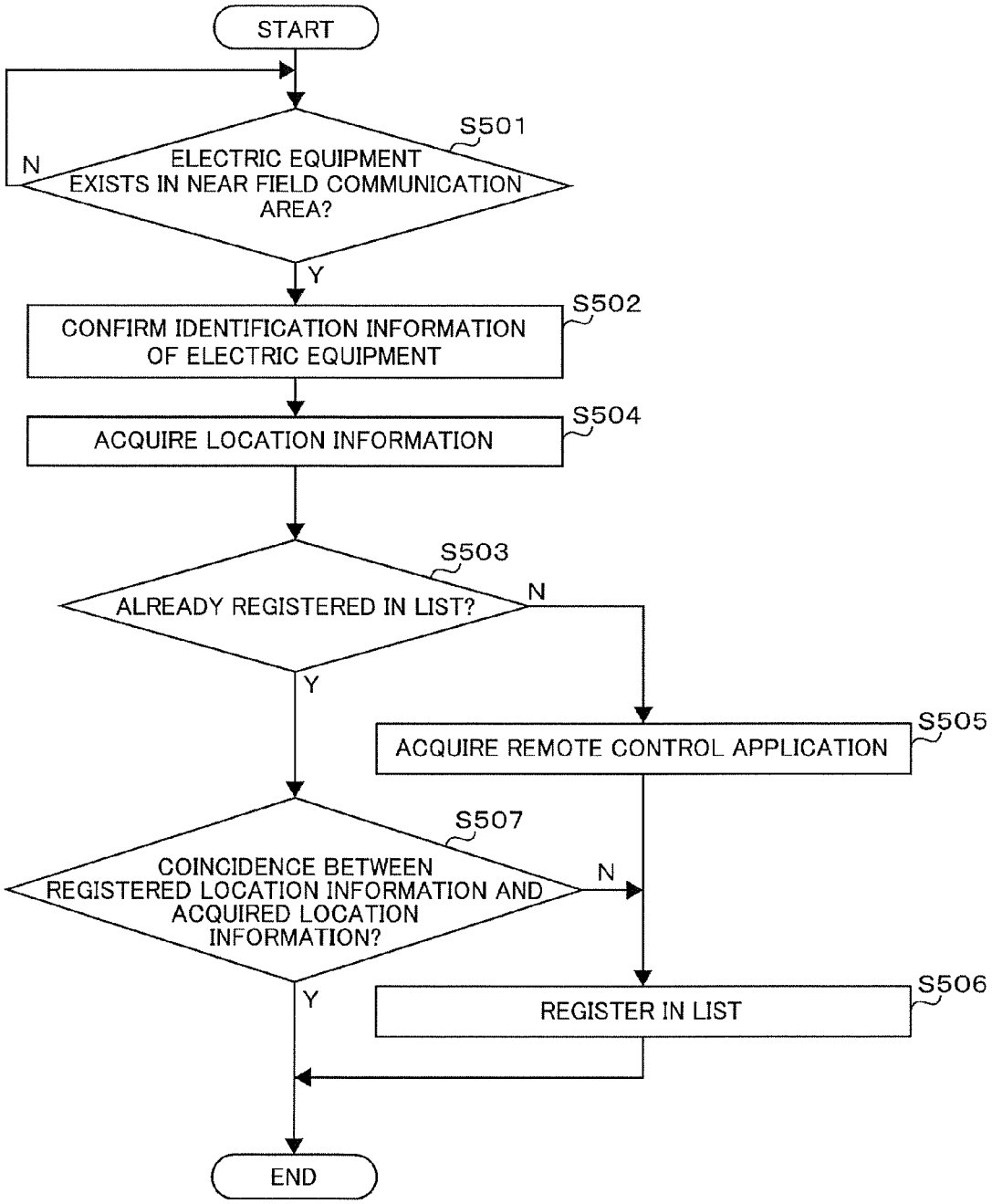
FIG. 5 is a flowchart for explaining a process for registering the electric equipment of the first embodiment.

FIG. 5 is a flowchart illustrating another example of a process for registering the electric equipment 3 by the terminal device 1 of the first embodiment of the present invention. In this process, a process for confirming whether the location information is the latest information is added to the registration process of FIG. 3.

In Step S501 to Step S502, the same procedures as those of Step S301 to Step S302 are performed, and thus will not be described again.

In Step S504, the same procedure as that of Step S304 is performed, and the present location information is acquired.

In Step S503, the terminal device 1 confirms whether the electric equipment 3 has already been registered in the list stored in the memory 202. When the electric equipment 3 has already been registered in the list, the flow proceeds to Step S507. When the electric equipment 3 has not been registered, the flow proceeds to Step S505.

In Step S505 to Step S506, the same procedures as those of Step S305 to Step S306 are performed, and a remote controller application of the electric equipment 3 is acquired. The identification information of the electric equipment 3, the remote controller application, the location information, and the product information are registered in the lists.

In Step S507, the terminal device 1 confirms whether there is a coincidence between registered location information of the electric equipment 3 and the location information acquired in Step S504. When there is no coincidence therebetween, the flow proceeds to Step S506, in which the latest location information acquired in Step S504 is registered again in the list.

Figure 6:
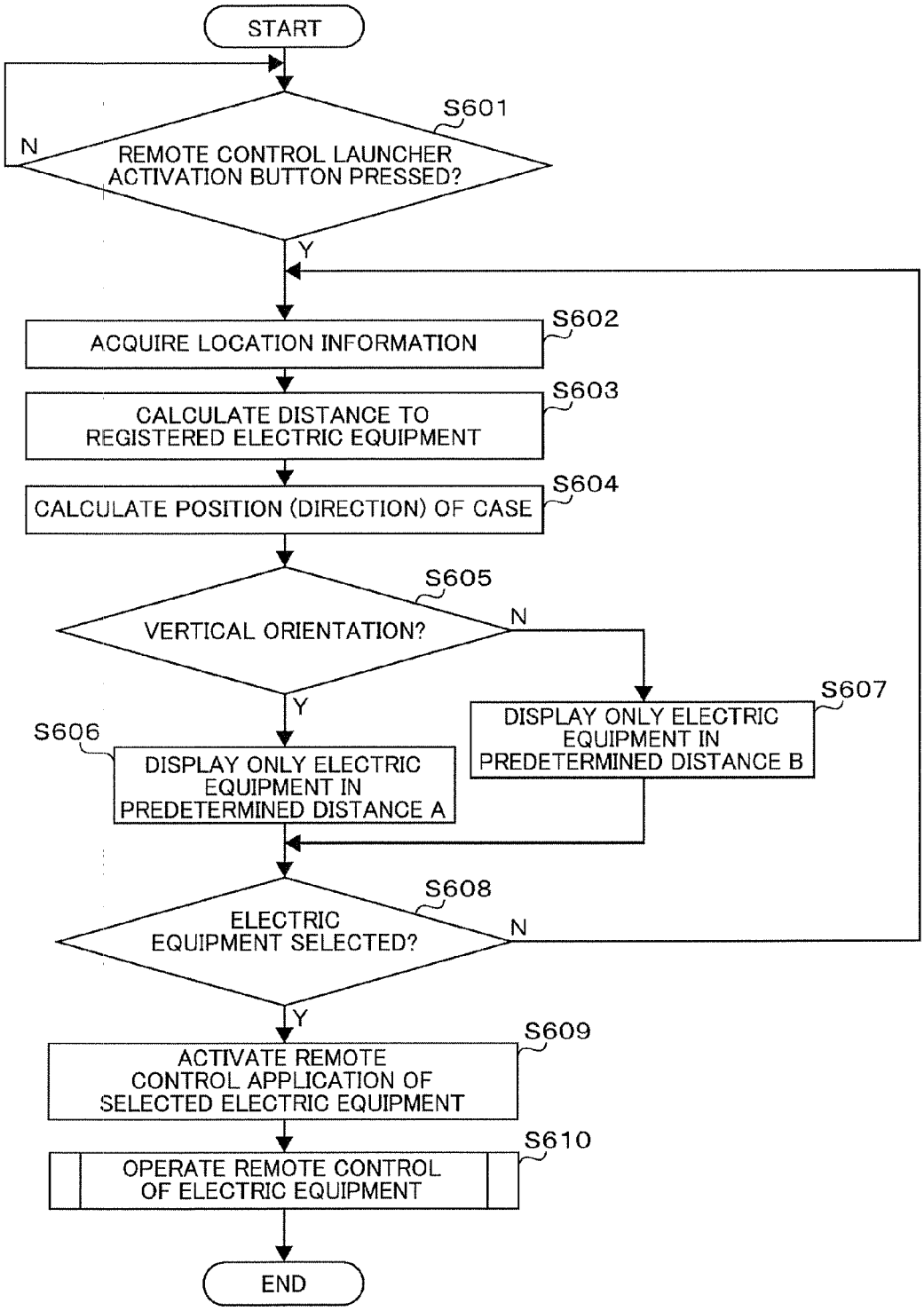
FIG. 6 is a flowchart for explaining a process for selecting electric equipment of the first embodiment.

FIG. 6 is a flowchart illustrating a process for selecting electric equipment 3 by the terminal device 1 of the first embodiment of the present invention. This flowchart illustrates a process for selecting a desired remote controller application with using the launcher application.

In Step S601, the terminal device 1 waits for a remote controller launcher activation button to be pressed by the user. For the remote controller launcher activation button, it is possible to assign, for example, a physical switch like a home button of the terminal device 1, or to assign an icon on the touch panel.

Figure 7A:
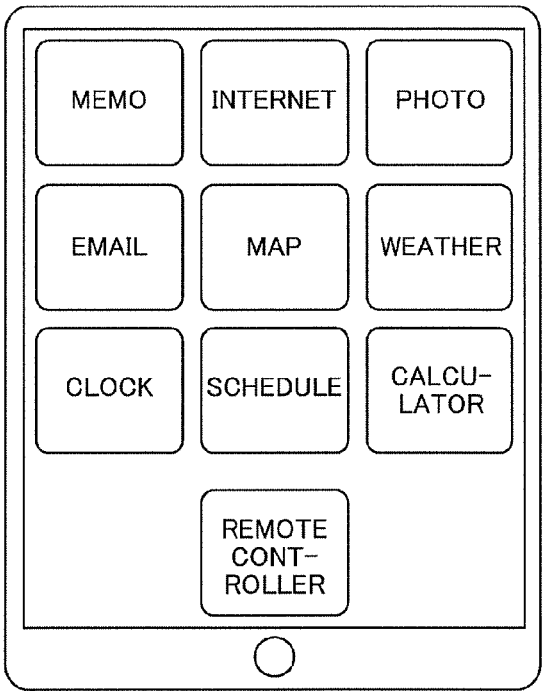
FIGS. 7A-7B are display examples of a liquid crystal panel of the terminal device of the first embodiment.
Figure 7B:
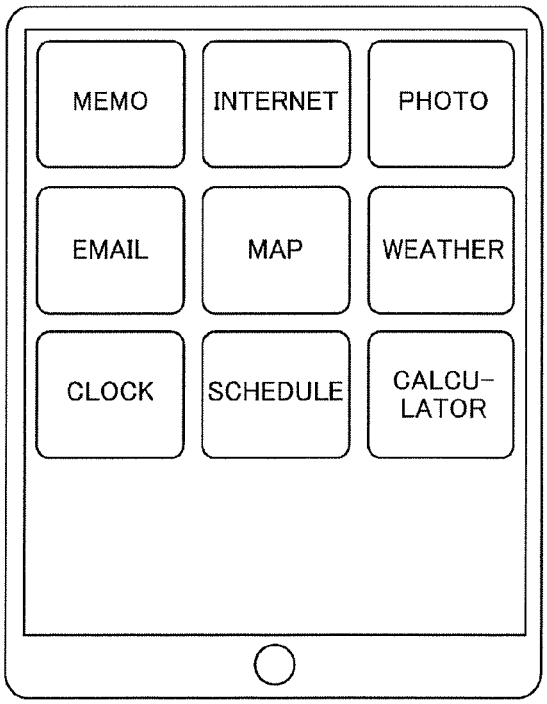

FIGS. 7A-7B are display examples of a touch panel of the terminal device 1. FIG. 7A is an example of a home screen of the terminal device 1 which displays a "remote controller" launcher icon included in icons of various applications displayed on the touch panel. Touching this icon is equivalent to pressing on the remote controller launcher activation button. Only when the terminal device 1 is at home, the "remote controller" launcher icon is displayed, as illustrated in FIG. 7A. When it is outside the home, the "remote controller" launcher icon is not displayed, as illustrated in FIG. 7B. This will prevent the user from activating the launcher application by touching the "remote controller" launcher icon unintentionally outside the home. Whether the terminal device 1 is at home or outside the home can be confirmed in accordance with whether the terminal device 1 is inside the communication area of the wireless router 4, or can be confirmed using the GPS or the like.

Upon pressing on the remote controller launcher activation button, the launcher application is activated, and the remote controller application is selected and activated.

The flow proceeds to Step S602, in which the location information acquisition unit 2103 acquires location information of the terminal device 1. The acquired location information represents the present location information of the terminal device 1 at the timing of pressing on the remote controller launcher activation button.

In Step S603, a distance between the terminal device 1 and the electric equipment 3 is calculated. The distance between the terminal device 1 and the electric equipment 3 is obtained based on the location information of the registered electric equipment 3 and the present location information of the terminal device 1.

In Step S604, the acceleration sensor 205 detects the gravitational acceleration, and the position (direction) of the case of the terminal device 1 is calculated. Inclination detection may also be performed using the gyro sensor 206, or any other sensors.

Figure 8:
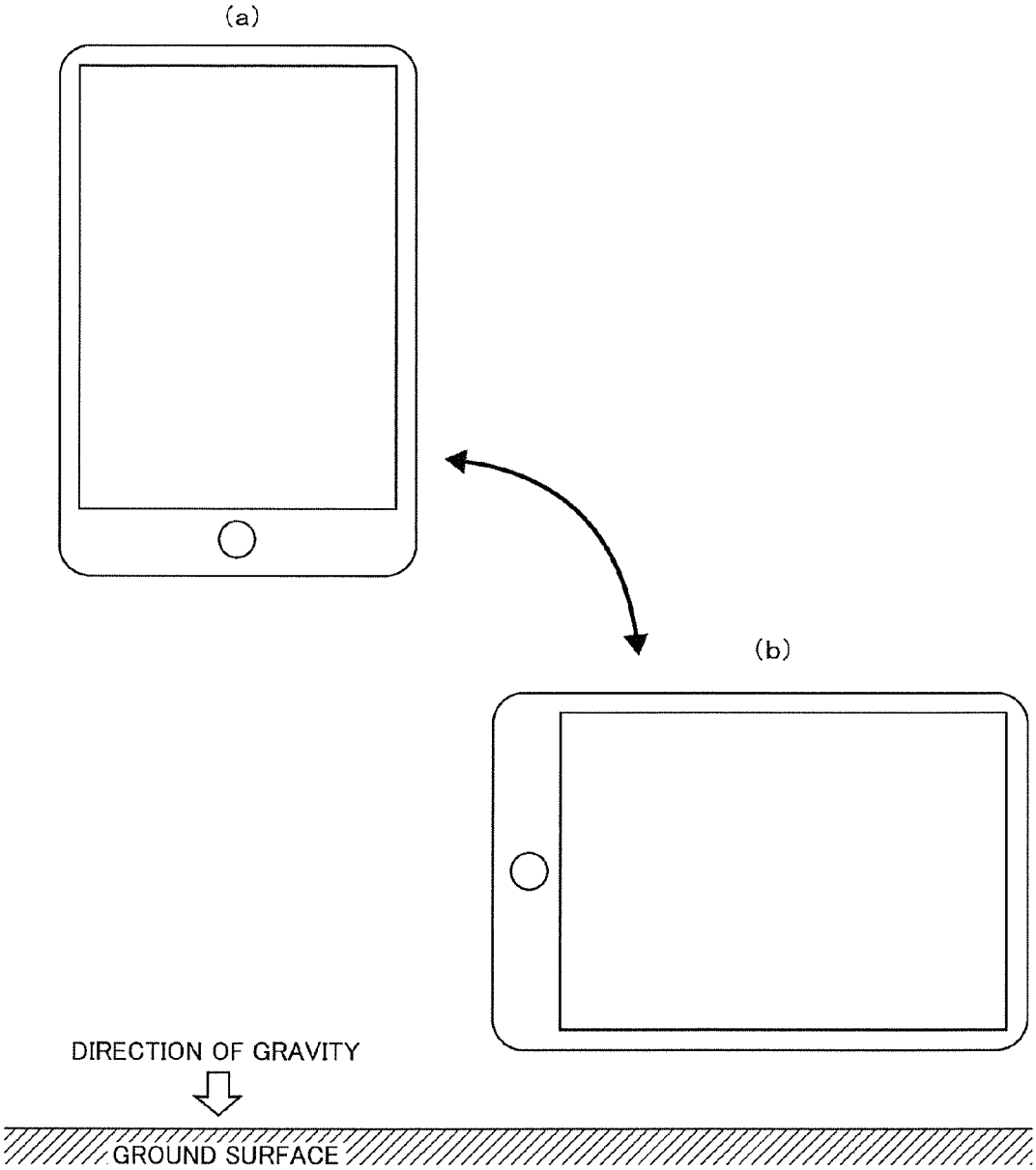
FIG. 8 is a diagram illustrating the position of a case of the terminal device of the first embodiment.

FIG. 8 is a schematic diagram illustrating a position of the case of the terminal device 1. A calculation is made as to whether the position of the case of the terminal device 1 is in a vertical attitude (the short side end of the case is nearer to the ground surface than the long side end) as illustrated in FIG. 8(*a*), or it is in a horizontal attitude (the long side end of the case is nearer to the ground surface than the short side end) as illustrated in FIG. 8(*b*). When the position of the case is calculated, there is no need to keep the case vertically.

In Step S605, the process is changed in accordance with whether the position of the case of the terminal device 1 is in a vertical attitude or a horizontal attitude. When it is in a vertical attitude, the flow proceeds to Step S606, in which only the electric equipment 3 in a preset predetermined distance A is displayed on the user interface unit 2108. When it is in a horizontal attitude, the flow proceeds to Step S607, in which the electric equipment 3 in a preset predetermined distance B is displayed. Alternatively, the registered electric equipment may entirely be displayed.

Figure 9:
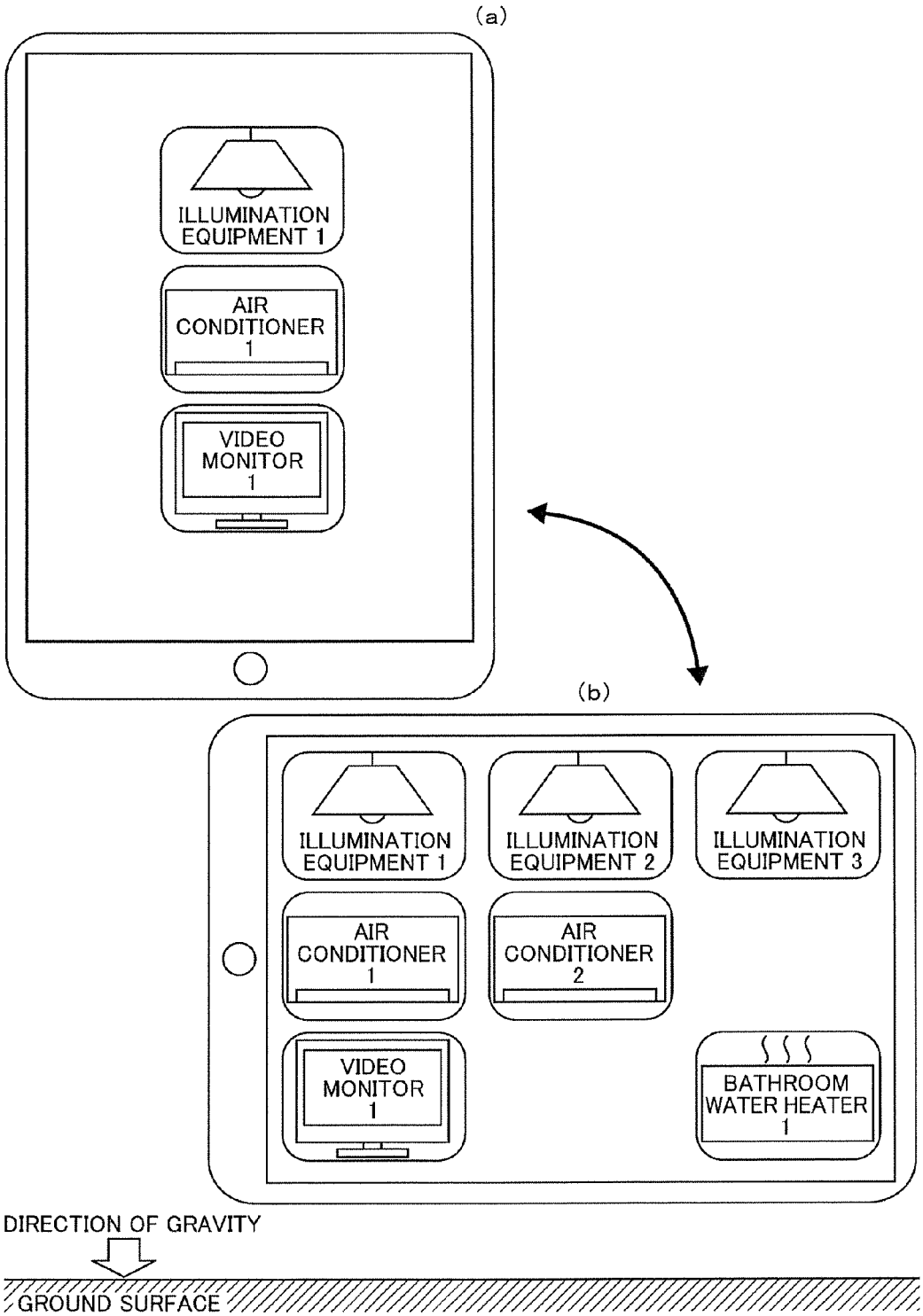
FIG. 9 is a display example of the liquid crystal panel of the terminal device of the first embodiment.

FIG. 9 is a display example of a liquid crystal panel of the terminal device 1. FIG. 9(*a*) is a display example of the liquid crystal panel when the position of the terminal device 1 is in a vertical attitude. The liquid crystal panel displays icons of illumination equipment, an air conditioner, and a video monitor, and shows that illumination equipment 3*a*1, an air conditioner 3*b*1, and a video monitor 3*c*1 exist in a predetermined distance A. Touching any of these icons activates the remote controller application of desired electric equipment 3, thereby enabling to remotely control the desired electric equipment 3.

FIG. 9(*b*) is a display example of a liquid crystal panel, when the position of the terminal device 1 is in a horizontal attitude. The liquid crystal panel displays icons of plural pieces of electric equipment 3. The pieces of electric equipment 3 existing in the predetermined distance A are displayed on the left end, and the pieces of electric equipment 3 existing in the predetermined distance are displayed side by side sequentially in an order away therefrom. The pieces of electric equipment 3 near to each other are displayed and arranged in a vertical manner.

Figure 10:
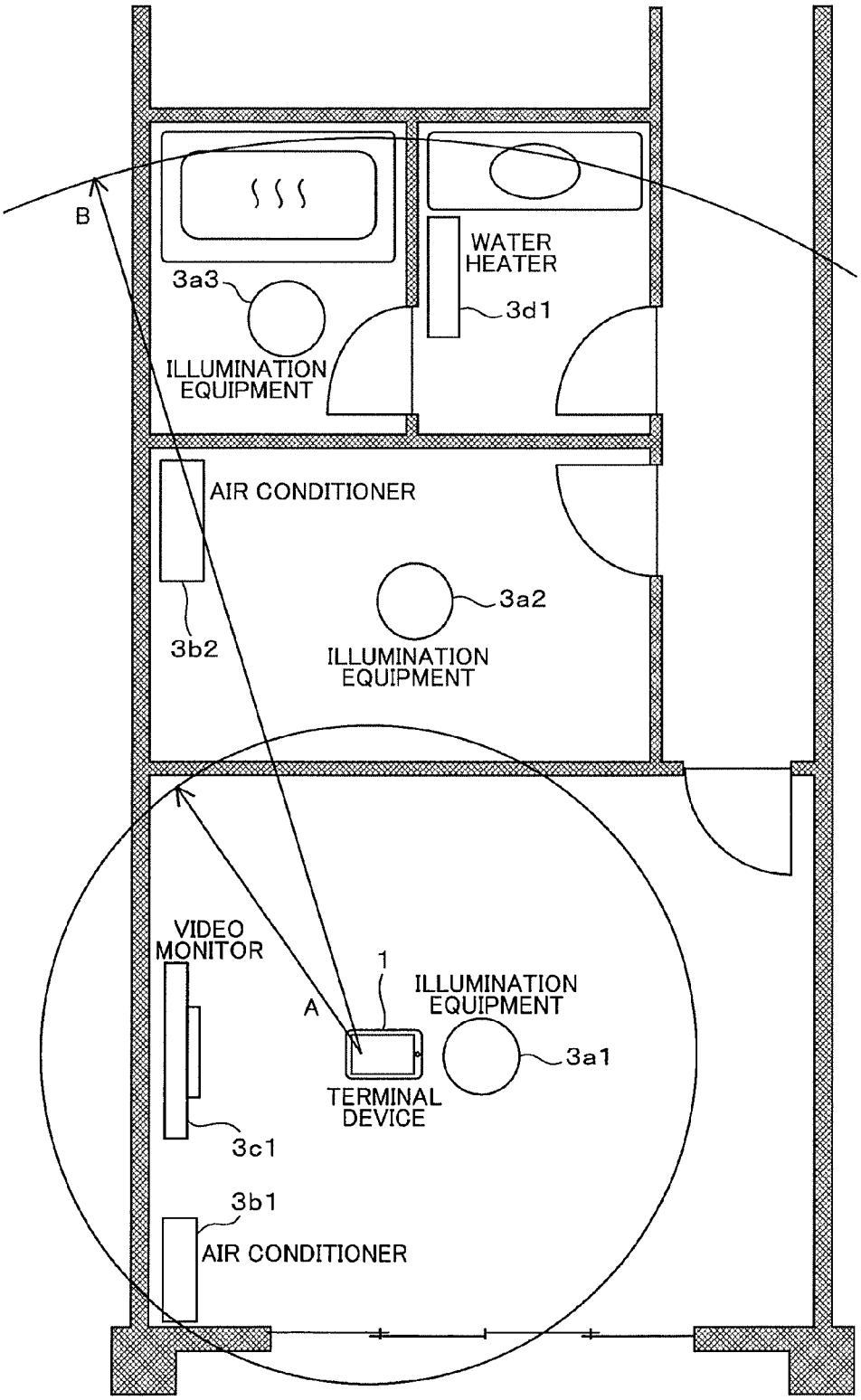
FIG. 10 is a layout diagram of a room layout and electric equipment of the first embodiment.

In the illustration, the illumination equipment 3*a*1, the air conditioner 3*b*1, and the video monitor 3*c*1 exist in the predetermined distance A, and illumination equipment 3*a*2, an air conditioner 3*b*2, an air conditioner 3*b*3, and a bathroom water heater 3*d*1 exist in positions beyond the predetermined distance A. When plural pieces of illumination equipment 3*a* and air conditioners 3*b* exist, the description is made like the illumination equipment 3*a*1, 3*a*2, 3*a*3, and the air conditioners 3*a*1, 3*a*2, 3*a*3, FIG. 10 illustrates a room layout and an arrangement example of electric equipment 3. The electric equipment 3 is arranged in a plurality of rooms. The electric equipment 3 is selected by the terminal device 1 for a remote controller operation.

In a room where the terminal device 1 exists, the illumination equipment 3*a*1, the air conditioner 3*b*1, and the video monitor 3*c*1 are provided. They are located in a predetermined distance A. In another room, the illumination equipment 3*a*2 and the air conditioner 3*b*2 are arranged. In still another room, the illumination equipment 3*a*3 and the bathroom water heater 3*d*1 are arranged. They are located in a predetermined distance B.

In Step S608, if the user has selected electric equipment 3 to be remotely operated, the flow proceeds to Step S609. If no selection has been made, the flow returns to Step S602, and continues the procedures.

In Step S609, the remote controller application corresponding to the selected electric equipment 3 is activated. At this time, information about the electric equipment 3 is given to the activated remote controller application, as needed. For example, the remote controller application corresponding to plural pieces of electric equipment 3 may require some kind of specifications of the electric equipment at the activation.

In Step S610, the user performs a remote controller operation of the electric equipment 3. Upon completion of the remote controller operation, the process is ended.

Figure 11A:
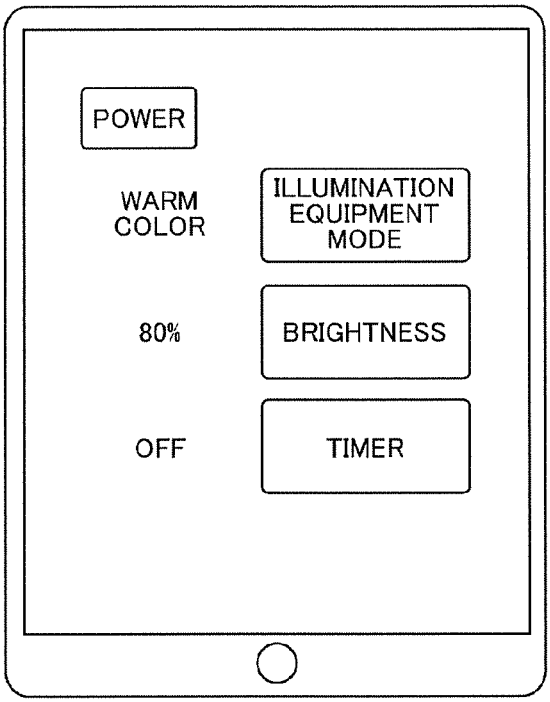
FIGS. 11A-11D are display examples of a liquid crystal panel of the terminal device of the first embodiment.
Figure 11B:
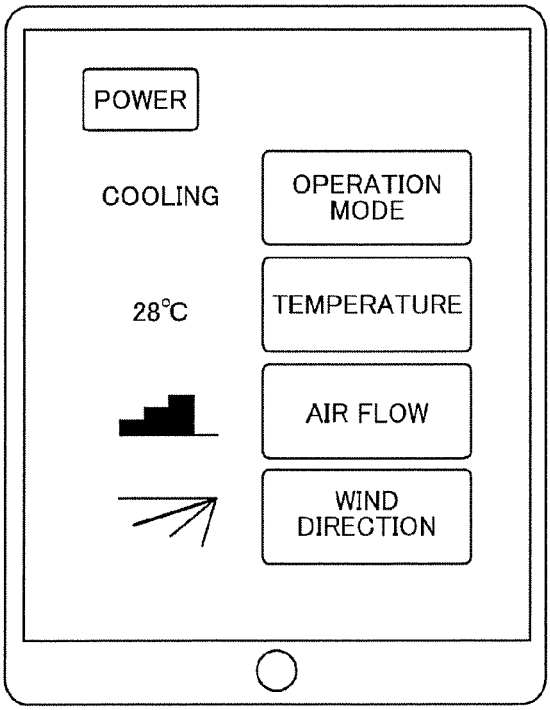
Figure 11C:
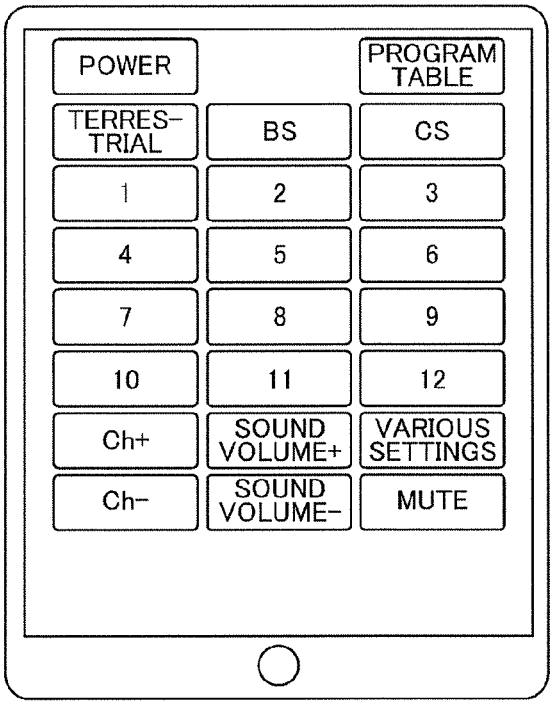
Figure 11D:
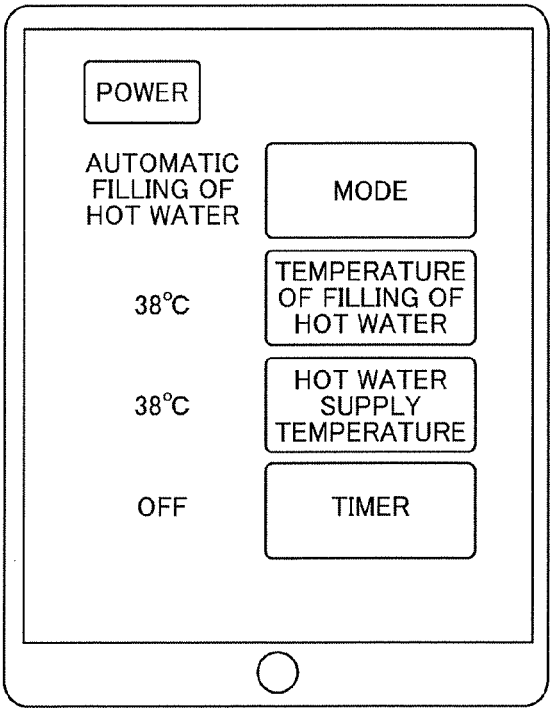

FIGS. 11A-11D are display examples of a liquid crystal panel when the remote controller application of the selected electric equipment 3 is activated. FIG. 11A is a display example of the liquid crystal panel, when a remote controller application of the illumination equipment 3*a* is activated. FIG. 11B is a display example of the liquid crystal panel, when a remote controller application of the air conditioner 3*b* is activated. FIG. 11C is a display example of the liquid crystal panel, when a remote controller application of the video monitor 3*c* is activated. FIG. 11D is a display example of the liquid crystal panel, when a remote controller application of the bathroom water heater 3*d* is activated.

If the predetermined distance A in Step S606 is set in consideration of, for example, the size of the room where the electric equipment 3 is provided, only the electric equipment 3 in the room can be displayed on the user interface unit 2108 when the position of the terminal device 1 is in a vertical attitude. The predetermined distance may be changed in accordance with location information. For example, even when there are a plurality of rooms and the rooms have respectively different room sizes, only the electric equipment 3 in each room can be displayed when the position of the terminal device 1 is in a vertical attitude. Further, when the remote controller launcher activation button is pressed, the room size is estimated based on the distance, for example, up to the registered nearest air conditioner 3*b*1. Then, the predetermined distance A may automatically be determined.

The predetermined distance B in Step S607 may be set in consideration of the size of, for example, an occupying part of a building. The size of the occupying part of the building is estimated based on the distance, for example, up to the registered farthest bathroom water heater 3*d*. Then, the predetermined distance B may automatically be determined.

According to the above configuration, in the first embodiment of the present invention, the terminal device acquires information necessary for remotely controlling the electric equipment in advance from the electric equipment. The information acquisition is performed, for example, by proximity wireless communication. At this time, the location information of the electric equipment is acquired using a function of the terminal device. The terminal device registers the information in the storage unit.

The terminal device acquires the location information upon pressing on the remote controller launcher activation button, and calculates the distance to the registered electric equipment.

Further, the terminal device calculates the position of the case, and switches the display in accordance with whether it is in the vertical attitude or the horizontal attitude. When it is in the vertical attitude, only the icon of the electric equipment in the predetermined distance A is displayed on the user interface. When it is in the horizontal attitude, the icon of the electric equipment in the predetermined distance B is displayed. Alternatively, when it is in the horizontal attitude, it is possible to display any icons of the electric equipment in the predetermined distance B except the pieces of electric equipment in the predetermined distance A. Alternatively, when it is in the horizontal attitude, it is possible to display the icons of all the pieces of electric equipment. When there is nearby electric equipment to be remotely controlled, the terminal device is made in the vertical attitude. When there is distant electric equipment, it is made in the horizontal attitude. As a result, it is possible to find an icon of desired electric equipment from among the icons of the plural pieces of electric equipment as soon as possible.

Upon selection of the icon, a corresponding remote controller application is activated, and the desired electric equipment is remotely controlled.

Alternatively, when it is in the horizontal attitude, only the icon of the electric equipment in the predetermined distance may be displayed on the user interface unit. When it is in the vertical attitude, the icons of all the pieces of electric equipment may be displayed.

Second Embodiment

Figure 12:
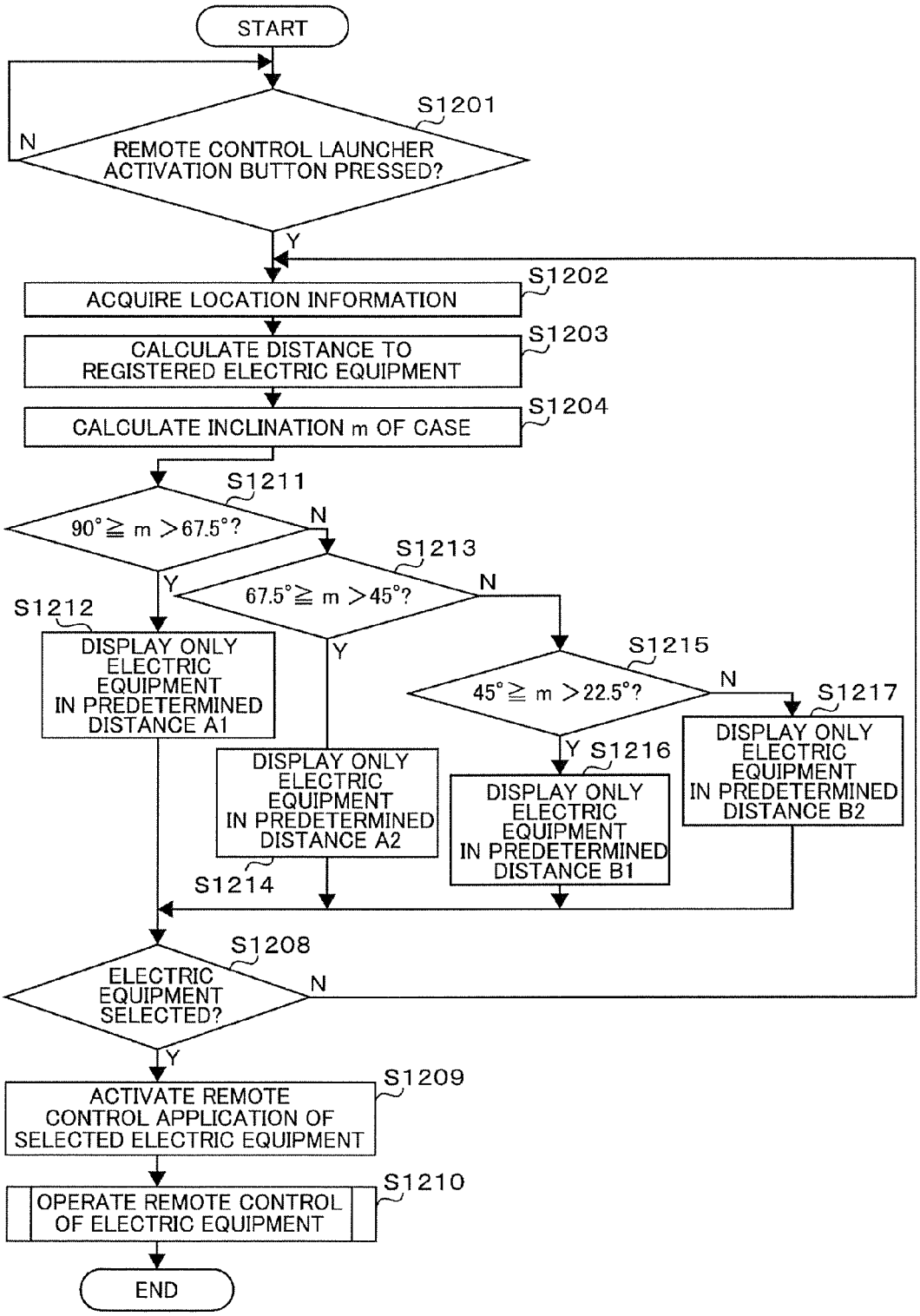
FIG. 12 is a flowchart for explaining a process for selecting electric equipment of a second embodiment.

FIG. 12 is a flowchart illustrating a process for selecting electric equipment 3 by a terminal device 1 of a second embodiment of the present invention. This flowchart illustrates a process for selecting a desired remote controller application with using a launcher application.

Step S1201 to Step S1204 are the same as Step S601 to Step S604 of FIG. 6.

In Step 1204, a gyro sensor 206 calculates the inclination of a case of a terminal device 1. Based on the calculated inclination information, procedures of the terminal device 1 are switched in Step S1211 to S1219.

In Step S1211, when the inclination "m" of the case of the terminal device 1 is 90°≥m≥67.5°, the flow proceeds to Step S1212, in which only the electric equipment in a predetermined distance A1 is displayed.

Figure 13:
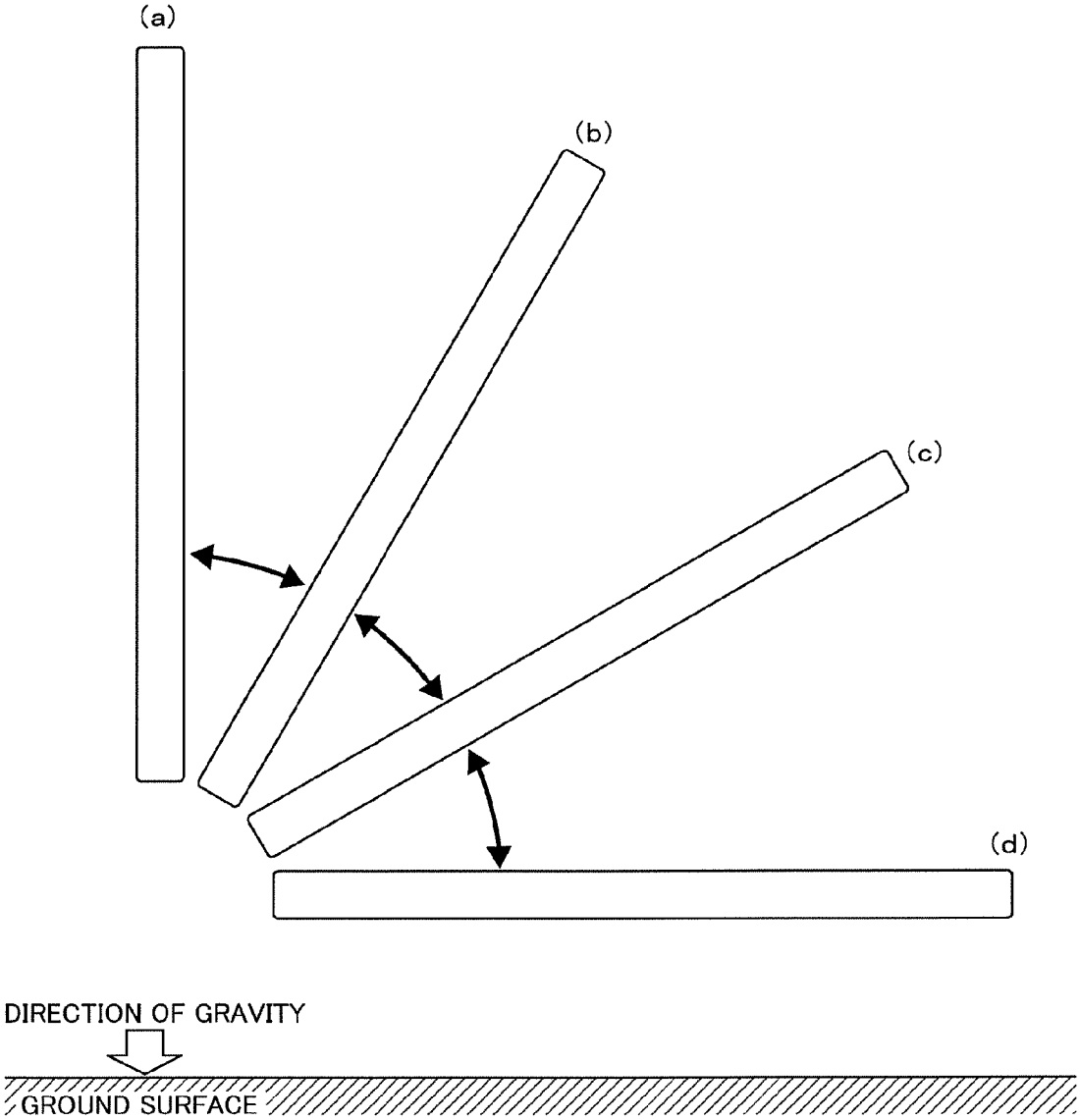
FIG. 13 is a diagram illustrating a position of a case of a terminal device of the second embodiment.

FIG. 13 is a schematic diagram illustrating a position of the case of the terminal 1, and illustrates its side surface when the case is inclined.

FIGS. 14A-14D are display examples of a liquid crystal panel of the terminal device 1.

Figure 14A:
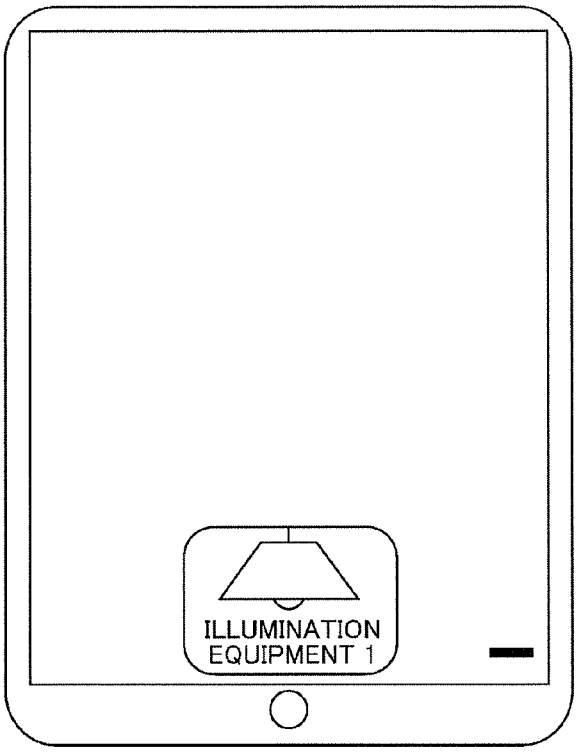
FIGS. 14A-14D are display examples of a liquid crystal panel of a terminal device of the second embodiment.

FIG. 13(*a*) is a diagram illustrating the position of the case of the terminal device 1, when the inclination "m" of the case of the terminal device 1 is 90°≥m>67.5°. FIG. 14A is a display example of the liquid crystal of the terminal device 1 at this time. The liquid crystal panel displays an icon of illumination equipment, and shows that only illumination equipment 3*a*1 exists in the predetermined distance A1. Touching this icon causes activation of the remote controller application of the desired electric equipment 3, thereby enabling to remotely control the desired electric equipment 3.

Figure 15:
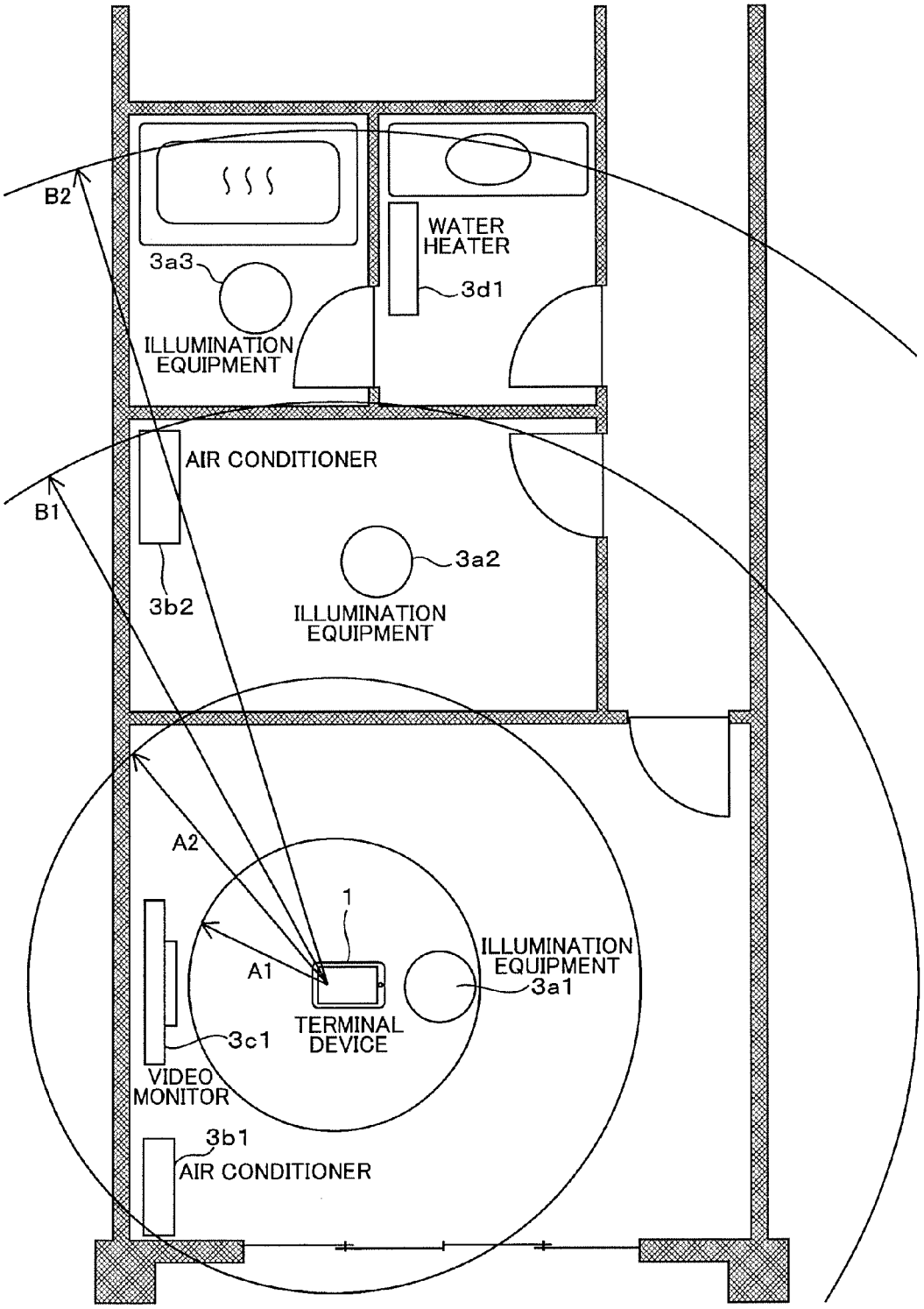
FIG. 15 is a layout diagram of a room layout and the electric equipment of the second embodiment.

FIG. 15 is a room layout diagram and illustrates a layout example of electric equipment 3. The electric equipment 3 is arranged in a plurality of rooms. The electric equipment 3 is selected by the terminal device 1 for a remote controller operation.

In a room where the terminal device 1 exists, the illumination equipment 3*a*1, an air conditioner 3*b*1, and a video monitor 3*c*1 are provided. The illumination equipment 3*a*1 is located in a predetermined distance A1 while the air conditioner 3*b*1 and the video monitor 3*c*1 are located in a predetermined distance A2. Illumination equipment 3*a*2 and an air conditioner 3*b*2 provided in another room are located in a predetermined distance B1. Illumination equipment 3*a*3 and a bathroom water heater 3*d*1 provided in still another room are located in a predetermined distance B2.

In Step S1213, when the inclination "m" of the terminal device 1 is 67.5°≥m>45°, the flow proceeds to Step S1214, in which only the electric equipment 3 in the predetermined distance A2 is displayed.

Figure 14B:
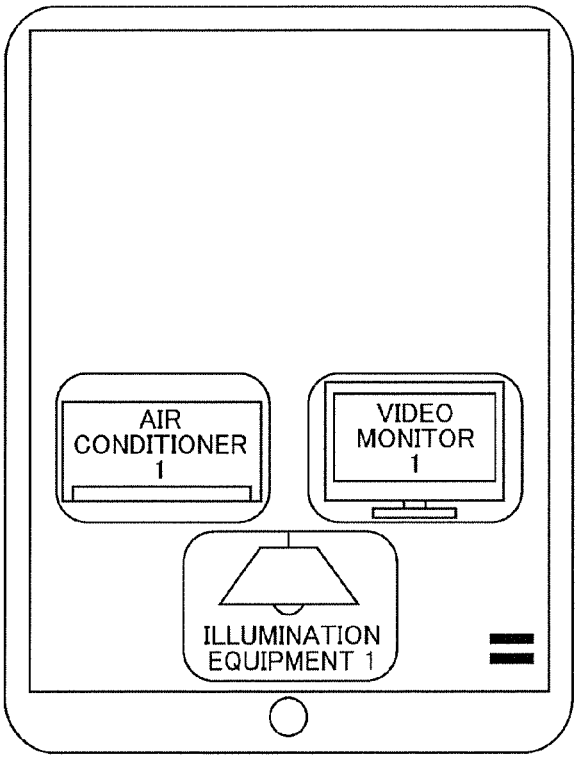

FIG. 13(*b*) is a diagram illustrating the position of the case of the terminal device 1 when the inclination "m" of the case of the terminal device 1 is 67.5°≥m>45°. FIG. 14B is a display example of the liquid crystal panel of the terminal device 1 at this time. The liquid crystal panel displays icons of the plural pieces of electric equipment 3, and shows that the illumination equipment 3*a*1, the air conditioner 3*b*1, and the video monitor 3*c*1 exist in the predetermined distance A2.

In Step S1215, when the inclination of the terminal device 1 is 45°≥m>22.5°, the flow proceeds to Step S1216, and only the electric equipment 3 in the predetermined distance B1 is displayed.

Figure 14C:
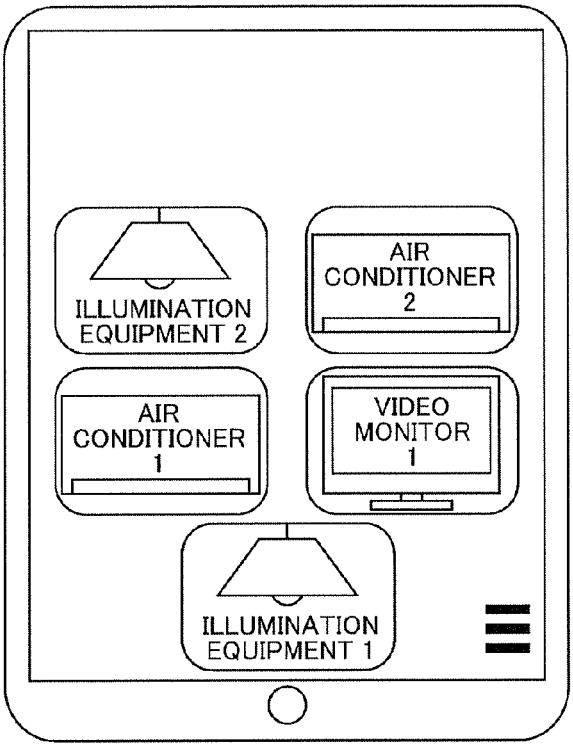

FIG. 13(*c*) is a diagram illustrating the position of the case of the terminal device 1 when the inclination "m" of the case of the terminal device 1 45°≥m>22.5°. FIG. 14C is a display example of the liquid crystal panel of the terminal device 1 at this time. The liquid crystal panel displays icons of the plural pieces of electric equipment 3, and shows that the illumination equipment 3*a*1, the air conditioner 3*b*1, the video monitor 3*c*1, the illumination equipment 3*a*2, and the air conditioner 3*b*2 exist in the predetermined distance B1.

When the inclination "m" of the terminal device 1 is 22.5°≥m, the flow proceeds to Step S1217, in which the electric equipment 3 in the predetermined distance B2 is displayed. Alternatively, all the pieces of registered electric equipment may be displayed.

Figure 14D:
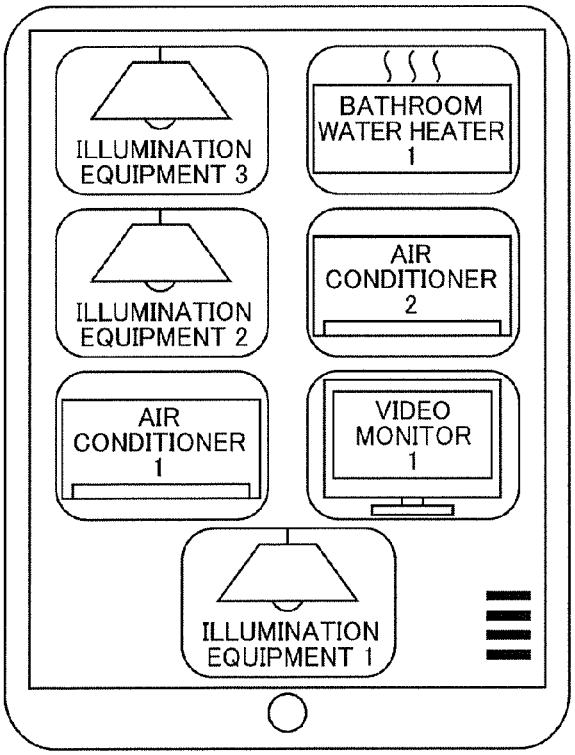

FIG. 13(*d*) is a diagram illustrating the position of the case of the terminal device 1, when the inclination of the case of the terminal device 1 is 22.5°≥m. FIG. 14D is a display example of the liquid crystal panel of the terminal device 1 at this time. The liquid crystal panel displays icons of the plural pieces of electric equipment 3, and shows that the illumination equipment 3*a*1, the air conditioner 3*b*1, the video monitor 3*c*1, the illumination equipment 3*a*2, the air conditioner 3*b*2, the illumination equipment 3*a*3, and the bathroom water heater 3*d*1 exist.

Step S1208 to Step S1210 are the same as Step S608 to Step S610 of FIG. 6.

In the example of this embodiment, the terminal device 1 is used in a vertical attitude. However, it may be used similarly even in a horizontal attitude.

In the example of this embodiment, the inclination of the terminal device 1 is classified into four ranges, and the display of the icons is switched between four manners. However, the inclination may be classified into any other ranges. As more ranges are made, the icon displays can be switched more smoothly.

In this embodiment, when the terminal device is vertically kept, only the icon of the electric equipment in a narrow range is displayed on the user interface unit. As the terminal device is horizontally inclined, the number of icons of the electric equipment to be displayed gradually increases. When it is in a horizontal attitude, the icons of the entire electric equipment are displayed. However, when the terminal device is vertically kept, only the icon of the nearby electric equipment is displayed. As the terminal device is horizontally inclined, the icons of the distant electric equipment are gradually displayed. When it is in the horizontal attitude, the icon of the farthest electric equipment may be displayed.

According to the above configuration, in the second embodiment of the present invention, the same effect as that of the first embodiment can be attained.

Further, the terminal device calculates the inclination of the case, and switches displays in accordance with its inclination. When the terminal device is vertically kept, only the icon of the electric equipment in a narrow range is displayed on the user interface unit. As the terminal device is inclined in a horizontal direction, the number of icons of the electric equipment to be displayed gradually increases. When it is in the horizontal attitude, the icons of all the pieces of electric equipment are displayed. When there is nearby electric equipment to be remotely controlled, the terminal device is brought closer into a vertical attitude. When there is distant electric equipment, it is brought closer into a horizontal attitude. As a result, it is possible to find an icon of desired electric equipment from among the icons of the plural pieces of electric equipment as soon as possible.

Upon selection of the desired icon, a corresponding remote controller application is activated, and the desired electric equipment can remotely be controlled.

Alternatively, when the terminal device is horizontally kept, only the icon of the electric equipment in a narrow range is displayed on the user interface unit. As the terminal device is inclined in a vertical direction, the number of icons of the electric equipment to be displayed gradually increases. When it is in the vertical attitude, the icons of all the pieces of electric equipment may be displayed.

Third Embodiment

Figure 16:
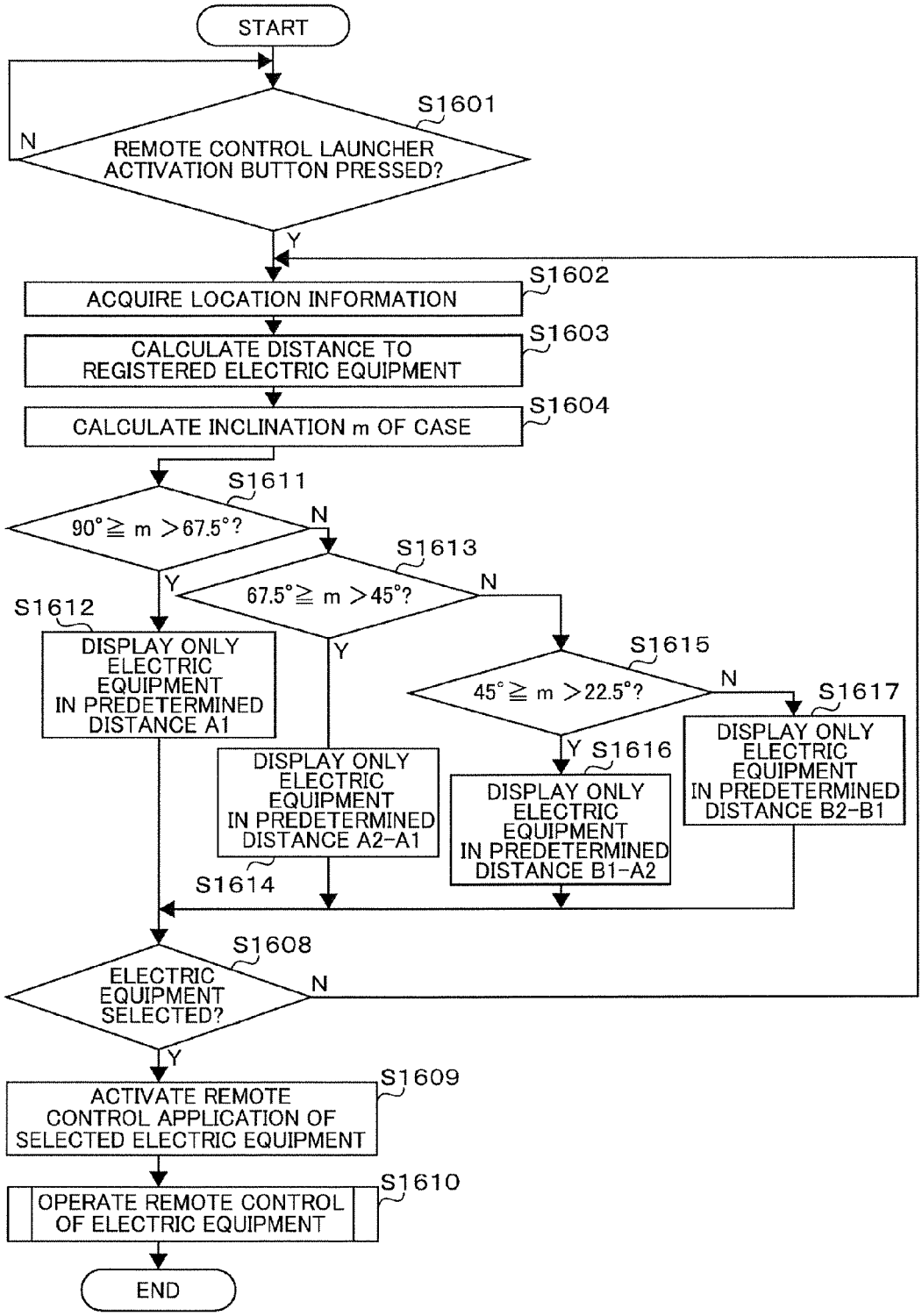
FIG. 16 is a flowchart for explaining a process for selecting electric equipment of a third embodiment.

FIG. 16 is a flowchart illustrating a process for selecting electric equipment by a terminal device 1 of a third embodiment of the present invention. This flowchart illustrates a process for selecting a desired remote controller application with using a launcher application.

Step S1601 to Step S1604 are the same as Step S601 to Step S604 of FIG. 6.

In Step S1611, when the inclination "m" of the case of a terminal device 1 is 90°≥m>67.5°, the flow proceeds to Step S1612, in which only the electric equipment 3 in a predetermined distance A1 is displayed.

Figure 17A:
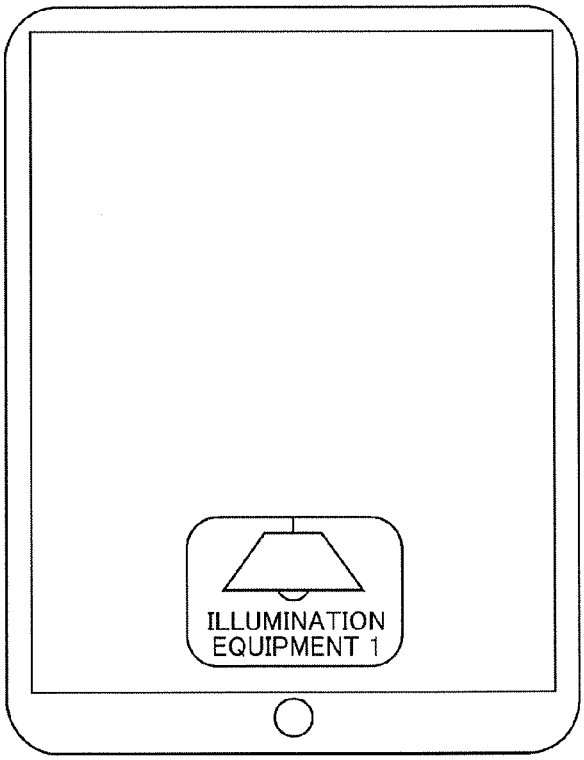
FIGS. 17A-17D are display examples of a liquid crystal panel of terminal device of the third embodiment.

FIGS. 17A-17D are display examples of a liquid crystal panel of the terminal device 1. FIG. 17A is a display example of the liquid crystal panel of the terminal device 1 at this time. The liquid crystal panel displays an icon of illumination equipment, and shows that only illumination equipment 3*a*1 exists in a predetermined distance A1. Touching this icon activates a remote controller application of desired electric equipment 3, thereby enabling to remotely control the desired electric equipment 3.

In Step S1613, when the inclination "m" of the terminal device 1 is 67.5°≥m>45°, the flow proceeds to Step S1614, in which only the electric equipment 3 in a predetermined distance A2-A1, that is, in A2 excluding A1, is displayed.

Figure 17B:
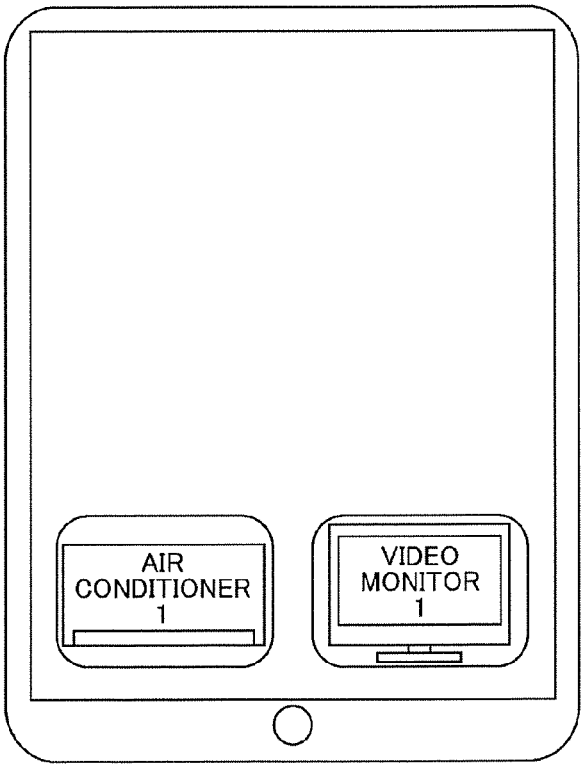

FIG. 17B is a display example of the liquid crystal panel of the terminal device 1 at this time. The liquid crystal panel displays icons of plural pieces of electric equipment 3, and shows that an air conditioner 3*b*1 and a video monitor 3*c*1 exist in the predetermined distance A2-A1.

In Step S1615, when the inclination "m" of the terminal device 1 is 45°≥m>22.5°, the flow proceeds to Step S1616 in which only the electric equipment 3 in a predetermined distance B1-A2, that is in B1 excluding A2, is displayed.

Figure 17C:
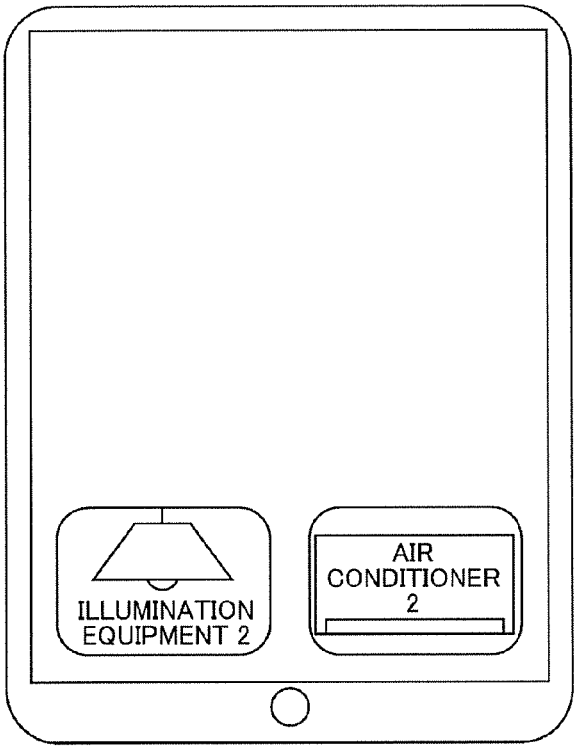

FIG. 17C is a display example of the liquid crystal panel of the terminal device 1 at this time. The liquid crystal panel displays icons of plural pieces of electric equipment 3, and shows that illumination equipment 3*a*2 and an air conditioner 3*b*2 exist in a predetermined distance B1-A2.

When the inclination "m" of the terminal device 1 is 22.5°≥m, the flow proceeds to Step S1617, in which the electric equipment 3 in a predetermined distance B2-B1, that is, in B2 excluding B1, is displayed.

Figure 17D:
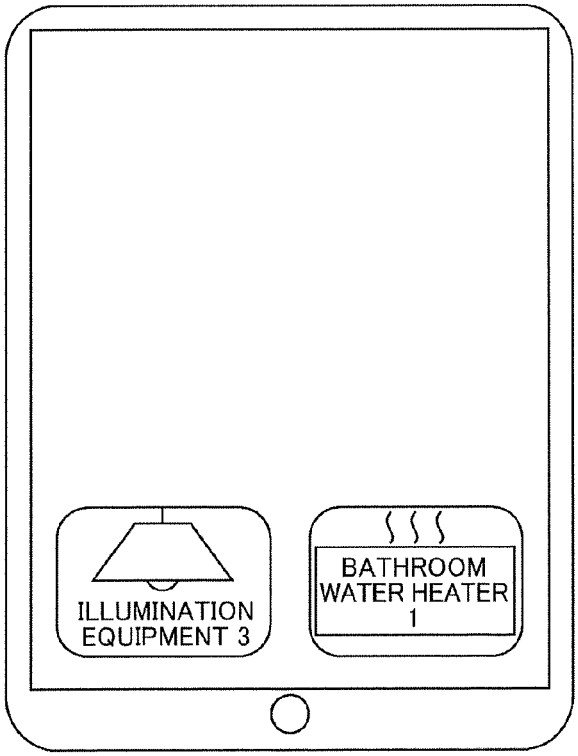

FIG. 17D is a display example of the liquid crystal panel of the terminal device 1 at this time. The liquid crystal panel displays icons of plural pieces of electric equipment 3, and shows that illumination equipment 3*a*3 and a bathroom water heater 3*d*1 exist.

Step S1608 to Step S1610 are the same as Step S1208 to Step S1210 of FIG. 12.

In the example of this embodiment, the terminal device 1 is used in a vertical attitude. However, it may be used similarly in a horizontal attitude.

In the example of this embodiment, the inclination of the terminal device 1 is classified into four ranges, and the display of the icons is switched between four manners. However, the inclination may be classified into any other ranges. As more ranges are made, the icon displays can be switched more smoothly. For example, pieces of the electric equipment 3 are displayed sequentially in an order near to the terminal device 1, in accordance with the inclination of the terminal device 1.

Figure 18A:
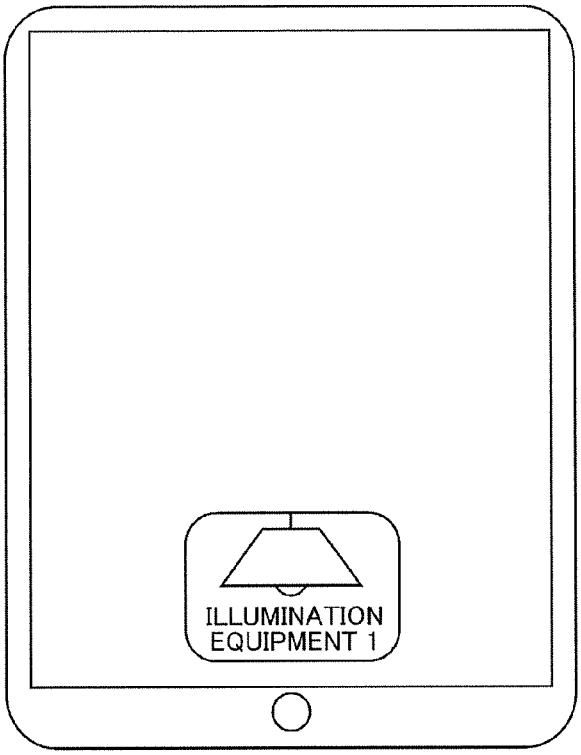
FIGS. 18A-18D are display examples of a liquid crystal panel of the terminal device of the third embodiment.

FIGS. 18A-18D are other display examples of the liquid crystal panel of the terminal device 1. FIG. 18A is another display example of the liquid crystal panel of the terminal device 1, when the inclination of the case of the terminal device 1 is about vertical (90°).

Figure 18B:
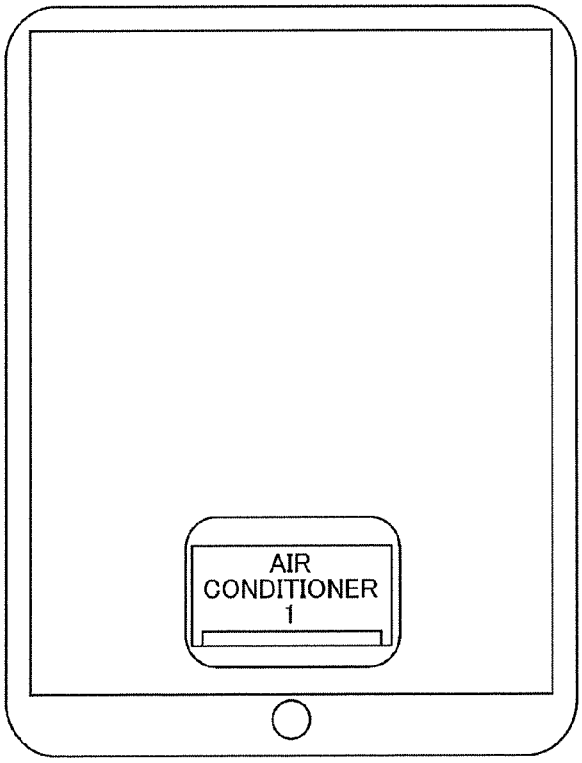
Figure 18C:
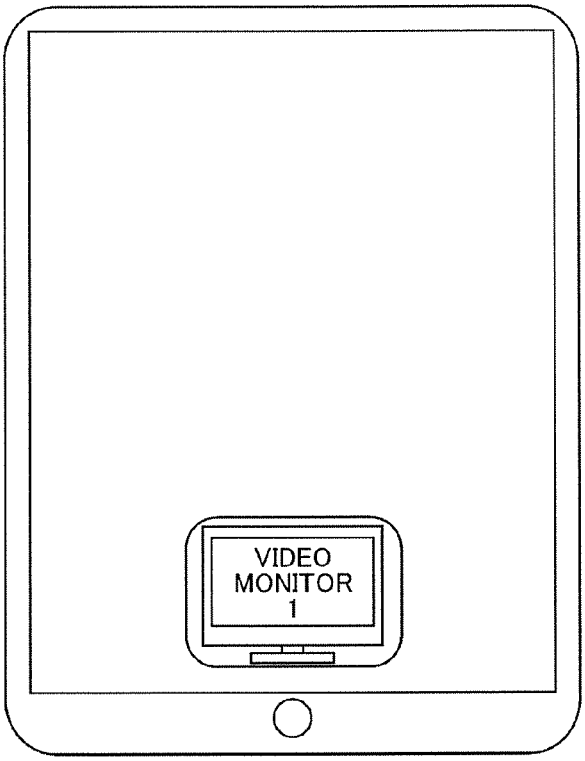
Figure 18D:
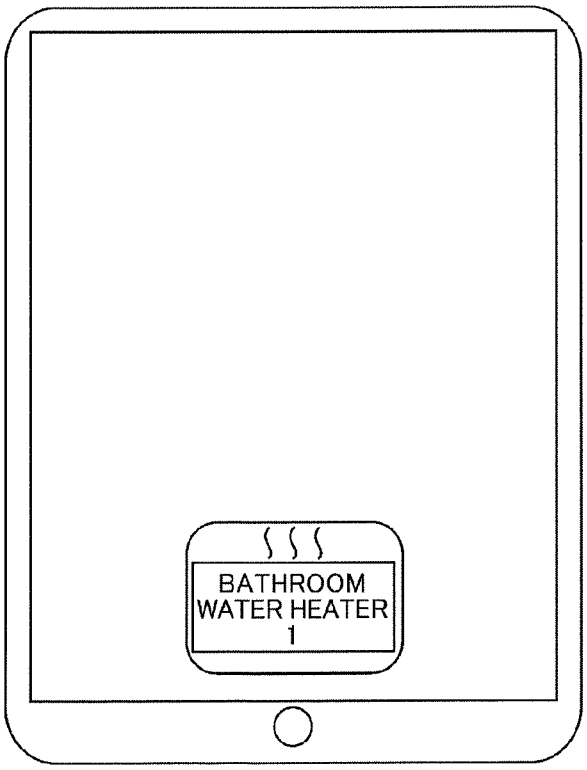

FIG. 18B is the display example of the liquid crystal panel, when the inclination of the case of the terminal device 1 is made a little closer to a horizontal attitude from a vertical attitude. FIG. 18C is the display example thereof, when the inclination of the case of the terminal device 1 is made further closer to the horizontal attitude. FIG. 18D is the display example thereof, when the inclination of the case of the terminal device 1 is about horizontal (0°).

Figure 19:
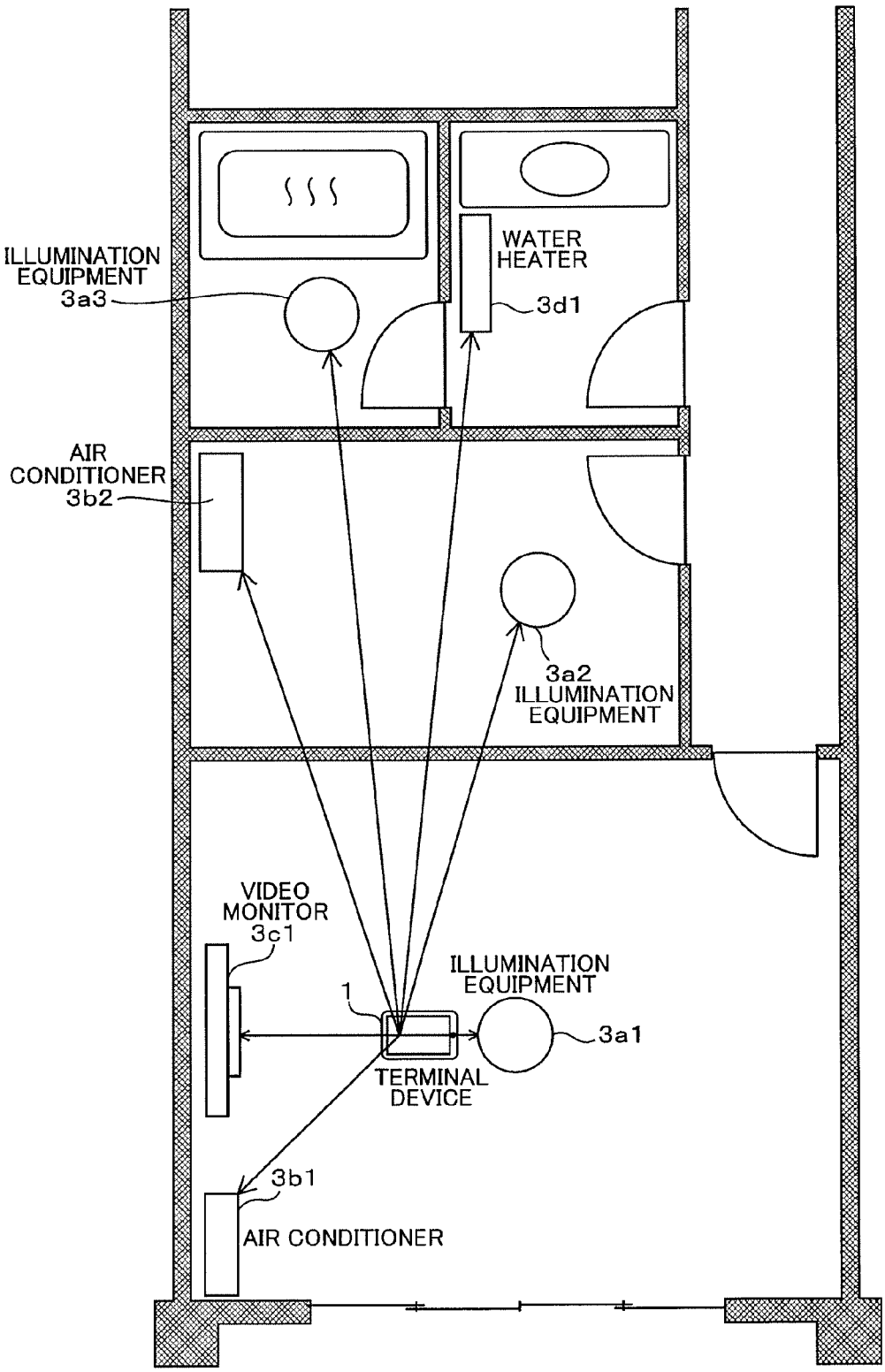
FIG. 19 is a layout diagram of a room layout and electric equipment of the third embodiment.

FIG. 19 is a layout diagram, and illustrates a layout example of the electric equipment 3. The electric equipment 3 is provided in a plurality of rooms, and the electric equipment 3 is selected by the terminal 1 for a remote controller operation. In this example, illumination equipment 3*a*1, a video monitor 3*c*1, an air conditioner 3*b*1, illumination equipment 3*a*2, an air conditioner 3*b*2, illumination equipment 3*a*3, and a bathroom water heater 3*d*1 are provided, in the order near to the terminal device 1.

According to the above configuration, in the third embodiment of the present invention, the same effect as that of the first embodiment can be attained.

Further, the terminal device calculates the inclination of the case, and switches the displays in accordance with the inclination. When the terminal device is vertically kept, only the electric equipment in a nearby range is displayed on the user interface unit. As the terminal device is inclined in a horizontal direction, the icon of the electric equipment in a distant range is gradually displayed. When it is in a horizontal attitude, the icon of the electric equipment in a range farthest from it is displayed.

Alternatively, when the terminal device is vertically kept, only the icon of the nearest electric equipment is displayed on the user interface unit. As the terminal device is inclined in a horizontal direction, the icon of the distant electric equipment gradually is displayed. When it is in a horizontal attitude, the icon of the farthest electric equipment is displayed.

When there is nearby electric equipment to be remotely controlled, the terminal device is brought closer to a vertical attitude. When there is distant electric equipment, it is brought closer to a horizontal attitude. As a result, it is possible to find an icon of desired electric equipment from among the icons of the plural pieces of electric equipment as soon as possible.

Fourth Embodiment

FIGS. 20A-20D are display examples of a liquid crystal panel of a terminal device 1 of a fourth embodiment of the present invention. The liquid crystal panel displays icons of plural pieces of electric equipment 3. The icons of the electric equipment 3 are arranged in the order near to the terminal device 1. The liquid crystal panel is an integrated touch panel with a touch pad. An operation of a scroll bar displayed on the right side can cause a shift of a display range.

Figure 20A:
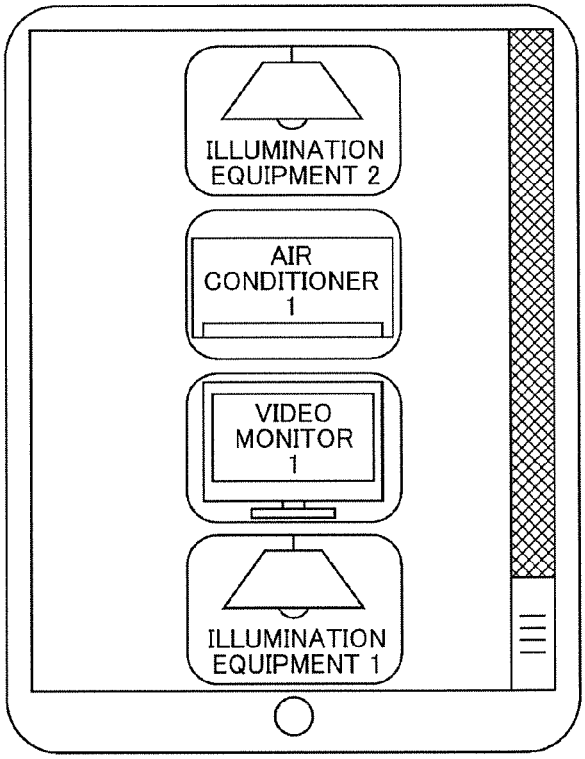
FIGS. 20A-20D are display examples of a liquid crystal panel of a terminal device of a fourth embodiment.

FIG. 20A is the display example, when the position of the scroll box of the scroll bar is shifted down to the lowest, and it displays the nearest illumination equipment 3*a*1, a video monitor 3*c*1, an air conditioner 3*b*1, up to illumination equipment 3*a*2.

Figure 20B:
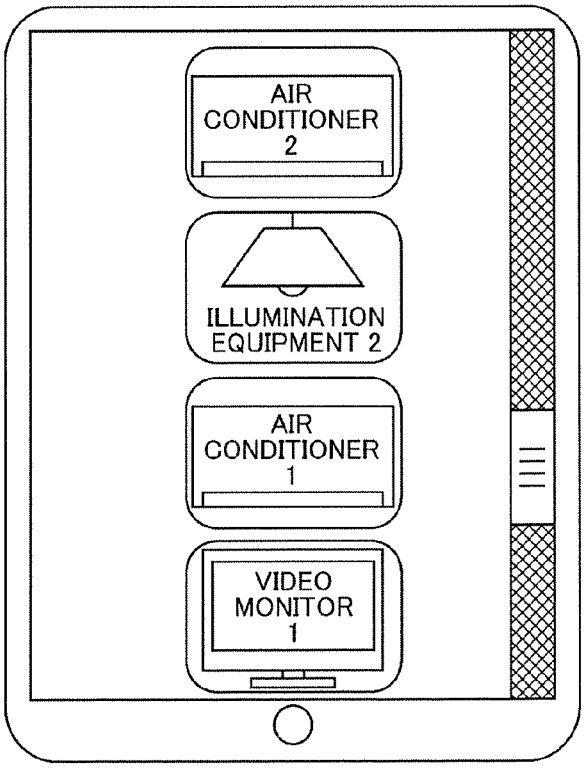

FIG. 20B is the display example, when the position of the scroll box of the scroll bar is shifted a little upward, and it displays the video monitor 3*c*1, the air conditioner 3*b*1, the illumination equipment 3*a*2, up to an air conditioner 3*b*2.

Figure 20C:
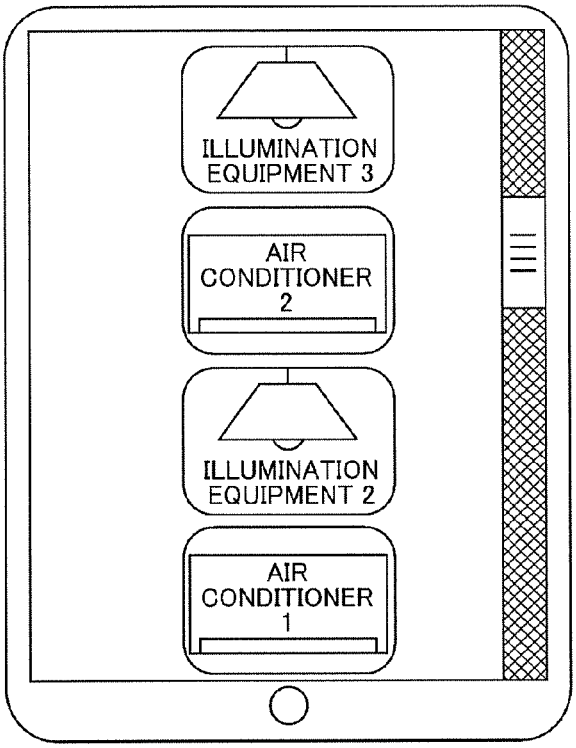

FIG. 20C is the display example, when the position of the scroll box of the scroll bar is shifted further upward, and it displays the air conditioner 3*b*1, the illumination equipment 3*a*2, the air conditioner 3*b*2, up to illumination equipment 3*a*3.

Figure 20D:
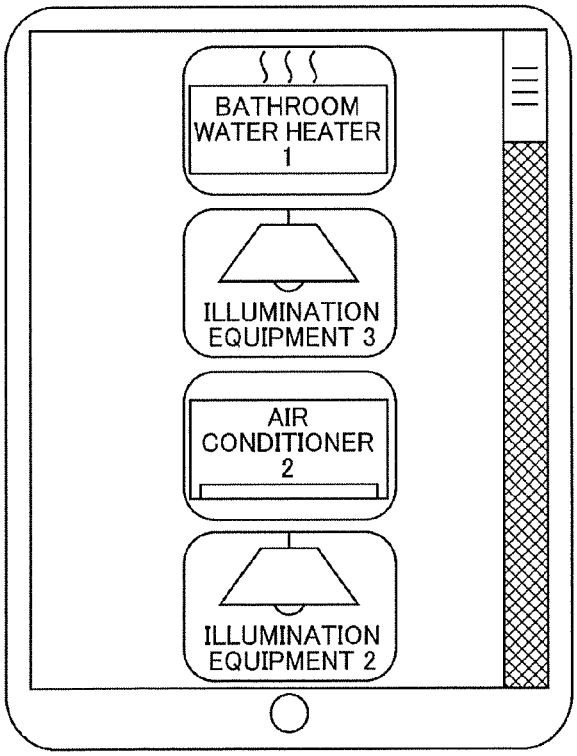

FIG. 20D is the display example when the position of the scroll box of the scroll bar is shifted up to the top, and it displays the illumination equipment 3*a*2, the air conditioner 3*b*2, the illumination equipment 3*a*3, up to a bathroom water heater 3*d*1.

In the example of this embodiment, the terminal device 1 is used in a vertical attitude. However, it may be used similarly in a horizontal attitude.

According to the above configuration, in the fourth embodiment of the present invention, the same effect as that of the first embodiment can be attained.

Further, the terminal device displays the electric equipment in the order of distance. The display position changes in accordance with whether electric equipment to be remotely controlled exists near thereto or far therefrom. Thus, it is possible to find an icon of desired electric equipment from among the icons of the plural pieces of electric equipment as soon as possible.

Upon selection of a desired icon, a corresponding remote controller application is activated, and the desired electric equipment can remotely be controlled.

The above-described embodiments have specifically been described to easily describe the present invention, but are not necessarily limited to any of those including all the above-described constituents. A partial configuration of an embodiment may be replaced with a configuration of another embodiment, or a configuration of an embodiment may be added to a configuration of another embodiment. A partial configuration of each embodiment may be added to, deleted from, or replaced with a configuration of another embodiment.

Each of the above-described configurations, functions, processing units, and processing means may partially or entirely be realized with hardware, for example, by designing it with an integrated circuit with an integrated circuit. The above-described configurations and functions may be realized with software by a processor interpreting a program for realizing and executing the functions. Information of the program, table, and file for realizing the functions may be placed in a recording device such as a memory, hard disk, or SSD (Solid State Drive), or on a recording medium such as an IC card, SD card or the like.

The control lines and the information lines have been described as those considered necessary for the sake of descriptions. However, all the control lines and the information lines may not necessarily be described for the products. In fact, it may be considered that almost all the configurations are mutually connected with each other.

REFERENCE SIGNS LIST

1 . . . Terminal Device
2 . . . Remote Controller
3 . . . Electrical Device
4 . . . Wireless Router
5 . . . Network

The invention claimed is:

1. A terminal device having a remote control function for electric equipment, including:

a location information detection means for acquiring a present location of the terminal device;

a storage means for storing location information of the electric equipment;

a display means for displaying information;

a distance calculation means for calculating a distance between the terminal device and the electric equipment, using location information of the terminal device which is acquired by the location information detection means and the location information of the electric equipment which is stored in the storage means;

a switching means for performing switching in accordance with whether the electric equipment is a target device to be operated, based on the distance calculated by the distance calculation means; and a case position detection means for detecting a position of a case of the terminal device, wherein electric equipment having the distance equal to or less than a predetermined value, calculated by the distance calculation means, is displayed on the display means, and switching of the predetermined value is performed in accordance with the position of the case of the terminal device detected by the case position detection means.

2. The terminal device according to claim 1, wherein the case position detection means comprises a case inclination calculation means for calculating inclination of a case of the terminal device, and switching of the predetermined value is performed in accordance with the inclination of the case of the terminal device which is calculated by the case inclination calculation means.

3. The terminal device according to claim 1, wherein the case position detection means comprises a case inclination calculation means for calculating inclination of a case of the terminal device, and switching of the electric equipment to be displayed on the display means is performed in accordance with the inclination of the case of the terminal device calculated by the case inclination calculation means.

4. The terminal device according to claim 1, wherein the electric equipment is displayed on the display means in order of the distance calculated by the distance calculation means.

5. A remote control method for electric equipment by a terminal device, including the steps of:

acquiring location information of the terminal device;

calculating a distance between the terminal device and the electric equipment, using the location information when registering the electric equipment and the location information when remote control is performed;

detecting a position of a case of the terminal device; and switching whether the electric equipment is a target to be operated when the distance is equal to or less than a predetermined value, wherein the predetermined value is determined in accordance with the position of the case of the terminal device.

6. The remote control method according to claim 5, including the steps of:

acquiring identification information of the electric equipment;

acquiring location information of the terminal device; and storing the location information of the terminal device in association with the identification information of the electric equipment.

* * * * *